US011087933B2

(12) United States Patent
Watanabe et al.

(10) Patent No.: US 11,087,933 B2
(45) Date of Patent: Aug. 10, 2021

(54) SAFETY SWITCH

(71) Applicant: IDEC Corporation, Osaka (JP)

(72) Inventors: Tatsuhiro Watanabe, Amagasaki (JP); Masatake Yamano, Akashi (JP)

(73) Assignee: IDEC Corporation, Osaka (JP)

( * ) Notice: Subject to any disclaimer, the term of this patent is extended or adjusted under 35 U.S.C. 154(b) by 0 days.

(21) Appl. No.: 16/489,909

(22) PCT Filed: Dec. 20, 2018

(86) PCT No.: PCT/JP2018/046993
§ 371 (c)(1),
(2) Date: Aug. 29, 2019

(87) PCT Pub. No.: WO2019/138833
PCT Pub. Date: Jul. 18, 2019

(65) Prior Publication Data

US 2020/0006016 A1 Jan. 2, 2020

(30) Foreign Application Priority Data

Jan. 11, 2018 (JP) ..... JP2018-002996

(51) Int. Cl.
*H01H 9/24* (2006.01)
*H01H 3/16* (2006.01)
(Continued)

(52) U.S. Cl.
CPC ..... *H01H 9/24* (2013.01); *H01H 3/163* (2013.01); *H01H 9/285* (2013.01); *H01H 27/002* (2013.01); *H01H 3/28* (2013.01)

(58) Field of Classification Search
CPC ..... H01H 27/002; H01H 9/24; H01H 9/285; H01H 3/162
See application file for complete search history.

(56) References Cited

U.S. PATENT DOCUMENTS 5,760,353 A 6/1998 Rapp
6,037,551 A * 3/2000 Fukui ..... H01H 27/002 200/43.04
(Continued)

FOREIGN PATENT DOCUMENTS

GB 2 489 525 10/2012
JP 07-122152 A 5/1995
(Continued)

OTHER PUBLICATIONS

English translation of the International Search Report of the International Searching Authority for International Application PCT/JP2018/046993, dated Apr. 2, 2019, 2 pages, Japan Patent Office, Tokyo, Japan.
(Continued)

*Primary Examiner* — Felix O Figueroa
(74) *Attorney, Agent, or Firm* — W. F. Fasse

(57) ABSTRACT

To prevent incoincidence of contacts, a safety switch switches the contacts by cooperation of an actuator and a switch body. The switch body includes an operating cam and a locking cam that rotate due to insertion of the actuator, an operating rod that switches the contact according to rotation of the operating cam, and a locking lever that is movable toward and away from the locking cam such that the locking lever takes a lock position in which it locks rotation of the locking cam and an unlock position in which it unlocks rotation of the locking cam. The locking lever includes a bulge protruding toward the locking cam. A cam contact surface of the locking lever contacts the locking cam when the actuator moves in a drawing-out direction in an intermediate position between the lock position and the unlock position.

8 Claims, 23 Drawing Sheets

IV Lock Position
III ON/OFF Switching Point of Lock Contact
II ON/OFF Switching Point of Unlock Contact
I Unlock Position

(51) Int. Cl.

| | |
|---|---|
| ***H01H 9/28*** | (2006.01) |
| ***H01H 27/00*** | (2006.01) |
| *H01H 3/28* | (2006.01) |

(56) References Cited

U.S. PATENT DOCUMENTS

| | | | | |
|---|---|---|---|---|
| 6,118,087 | A | 9/2000 | Fukui | |
| 7,999,200 | B2 * | 8/2011 | Komori | H01H 3/161 200/324 |
| 8,803,013 | B2 * | 8/2014 | Mohtasham | H01H 27/002 200/329 |
| 10,861,660 | B2 * | 12/2020 | Watanabe | H01H 27/002 |
| 2008/0121499 | A1 * | 5/2008 | Komori | H01H 27/002 200/43.16 |

FOREIGN PATENT DOCUMENTS

| | | | |
|---|---|---|---|
| JP | 07-127795 | A | 5/1995 |
| JP | 09-502298 | A | 3/1997 |
| JP | 10-334772 | A | 12/1998 |
| JP | 2012-221955 | A | 11/2012 |
| WO | WO 95/06323 | | 3/1995 |
| WO | WO 2006/117965 | | 11/2006 |
| WO | WO 2007/066803 | | 6/2007 |

OTHER PUBLICATIONS

PCT International Preliminary Report on Patentability including English Translation of PCT Written Opinion of the International Searching Authority for International Application PCT/JP2018/046993, dated Jul. 14, 2020, 6 pages, International Bureau of WIPO, Geneva, Switzerland.

Japanese Office Action in Japanese Patent Application No. 2018-002996, dated Apr. 28, 2020, 4 pages, with partial English translation, 2 pages.

* cited by examiner

| Operation No. (1) | |
|---|---|
| Actuator Moving toward Insertion Direction | |
| Lock State | Unlock |
| Solenoid | OFF |
| Lock Contact | OFF |
| Unlock Contact | ON |

IV Lock Position
III ON/OFF Switching Point of Lock Contact
II ON/OFF Switching Point of Unlock Contact
I Unlock Position

| Operation No. (2) | |
|---|---|
| Actuator Moving toward Insertion Direction | |
| Lock State | Unlock → Lock |
| Solenoid | OFF |
| Lock Contact | OFF → ON |
| Unlock Contact | OFF |

IV Lock Position
III ON/OFF Switching Point of Lock Contact
II ON/OFF Switching Point of Unlock Contact
I Unlock Position

| Operation No. (3) | |
|---|---|
| Actuator Moving toward Insertion Direction | |
| Lock State | Lock |
| Solenoid | OFF |
| Lock Contact | ON |
| Unlock Contact | OFF |

IV Lock Position
III ON/OFF Switching Point of Lock Contact
II ON/OFF Switching Point of Unlock Contact
I Unlock Position

| Operation No. (4) | |
|---|---|
| Actuator Moves in Drawing-out Direction and Stops after Lock Cam is Switched into Intake Position | |
| Lock State | Unlock |
| Solenoid | ON |
| Lock Contact | OFF |
| Unlock Contact | ON |

IV Lock Position
III ON/OFF Switching Point of Lock Contact
II ON/OFF Switching Point of Unlock Contact
I Unlock Position IV Lock Position
III ON/OFF Switching Point of Lock Contact
II ON/OFF Switching Point of Unlock Contact
I Unlock Position

| Operation No. (5) | |
|---|---|
| Mechanical Lock/Unlock Switching Point | |
| Lock State | Unlock → Lock |
| Solenoid | OFF |
| Lock Contact | OFF |
| Unlock Contact | ON |

IV Lock Position
III ON/OFF Switching Point of Lock Contact
II ON/OFF Switching Point of Unlock Contact
I Unlock Position IV Lock Position
III ON/OFF Switching Point of Lock Contact
II ON/OFF Switching Point of Unlock Contact
I Unlock Position IV Lock Position
III ON/OFF Switching Point of Lock Contact
II ON/OFF Switching Point of Unlock Contact
I Unlock Position IV Lock Position
III ON/OFF Switching Point of Lock Contact
II ON/OFF Switching Point of Unlock Contact
I Unlock Position

| Operation No. (8) | |
|---|---|
| Actuator Moves in Drawing-out Direction and Stops after Lock Cam is Switched into Intake Position | |
| Lock State | Lock |
| Solenoid | OFF |
| Lock Contact | ON |
| Unlock Contact | OFF |

IV Lock Position
III ON/OFF Switching Point of Lock Contact
II ON/OFF Switching Point of Unlock Contact
I Unlock Position

| Operation No. (9) | |
|---|---|
| Actuator Moves in Drawing-out direction | |
| Lock State | Lock |
| Solenoid | OFF |
| Lock Contact | ON |
| Unlock Contact | OFF |

IV Lock Position
III ON/OFF Switching Point of Lock Contact
II ON/OFF Switching Point of Unlock Contact
I Unlock Position

| Operation No. (10) | |
|---|---|
| Actuator Moves in Drawing-out direction | |
| Lock State | Lock |
| Solenoid | ON |
| Lock Contact | ON |
| Unlock Contact | OFF |

IV Lock Position
III ON/OFF Switching Point of Lock Contact
II ON/OFF Switching Point of Unlock Contact
I Unlock Position IV Lock Position
III ON/OFF Switching Point of Lock Contact
II ON/OFF Switching Point of Unlock Contact
I Unlock Position

| Operation No. (11) | |
|---|---|
| Actuator Moves in Drawing-out direction | |
| Lock State | Lock |
| Solenoid | ON |
| Lock Contact | ON → OFF |
| Unlock Contact | OFF |

IV Lock Position
III ON/OFF Switching Point of Lock Contact
II ON/OFF Switching Point of Unlock Contact
I Unlock Position

| Operation No. (12) | |
|---|---|
| Actuator Moves in Drawing-out direction | |
| Lock State | Unlock |
| Solenoid | ON |
| Lock Contact | OFF |
| Unlock Contact | ON |

IV Lock Position
III ON/OFF Switching Point of Lock Contact
II ON/OFF Switching Point of Unlock Contact
I Unlock Position

SAFETY SWITCH

TECHNICAL FIELD

The present invention relates generally to a safety switch that switches a contact by cooperation of an actuator and a switch body, and more particularly, to an improvement of the structure in order to prevent incoincidence of the contact from occurring.

BACKGROUND ART

At an entrance of a hazard area where an industrial machine such as an automatically operated machine tool is set on, a safety switch is provided that is switched on/off according to opening/closing state of a door.

For example, Japanese patent application publication No. 1997-502298 discloses in FIG. 1 a safety switch (1), which includes a key (or actuator) (5) disposed on the door side, a headpiece housing (3) disposed on the wall side and having a keyway (or actuator insertion hole) (4), and a housing (2). Inside the headpiece housing (3), a wheel with a notch (or cam) (9) is provided that is rotatable forwardly and reversely according to insertion/extraction of the key (5) into/from the keyway (4). Inside the housing (2), there are provided a reciprocatable plunger (6) that engages with a rest notch (15) of the wheel (9) in a rotational position at the time of door closing to lock the wheel (9) and a switch (8) that switches contacts according to motion of the plunger (6).

In such a safety switch, as the door closes, the key (5) is inserted into the keyway (4) to rotate the wheel (9) and a distal end portion of the spring-biased plunger (6) engages with the rest notch (15) of the wheel (9) to lock the wheel (9). As a result, the contacts of the switch (8) are switched from OFF to ON, so that the machine is powered on. At this time, since the wheel (9) is locked, an operator is prevented from opening the door during operation of the machine and he/she is thus prevented an access to the hazard area. On the other hand, when a stator (12) around the plunger (6) is energized in a lock state of the wheel (9), the distal end portion of the plunger (6) is extracted from the rest notch (15) of the wheel (9) and the plunger (6) moves backward. As a result, the lock state of the wheel (9) is released and unlocked, and thus the operator can open the door. At this time, the machine is powered off and its operation is stopped.

In the safety switch shown in JP 1997-502298, a semi-circular distal end portion of the plunger (6) is merely engaged with a semi-circular rest notch (15) of the wheel (9) in order to lock the wheel (9), which lacks in stability as a lock state.

Therefore, a safety switch is proposed that has a lock member provided discretely from a plunger. For example, a safety switch shown in FIGS. 20 to 22 of Japanese patent application publication No. 1998-334772 includes a swingable lock lever (50) that is engageable with a locking step (1d) formed on an outer circumferential surface of the drive cam (1). A distal engagement piece (50a) of the lock lever (50) is elastically biased toward the outer circumferential surface of the drive dam (1) by a spring force.

When the drive cam (1) is rotationally moved to a lock position by insertion of the actuator (102), the engagement piece (50a) of the lock lever (50) moves radially inwardly from the outer circumferential surface of the drive cam (1) and engages with the locking step (1d) to lock the drive cam (1) (see para. [0061]). On the other hand, when a solenoid structural part (213) (see FIG. 19) is energized in a lock state of the drive cam (1), the plunger (90a) is retracted and the engagement piece (50a) of the lock lever (50) moves radially outwardly from the drive cam (1) and is thus disengaged from the locking step (1d). As a result, the lock state of the drive cam (1) is released and unlocked (see para. [0062]).

PRIOR ART REFERENCES

Patent Documents i) Japanese Patent Application Publication No. 1997-502298 (see FIG. 1); and ii) Japanese Patent Application Publication No. 1998-334772 (see paras. [0061], [0062] and FIGS. 19-22).

SUMMARY OF THE INVENTION

Objects to be Achieved by the Invention

In either of the above-mentioned safety switches, during the process of the locking motion of the wheel (9) and the drive cam (1), a reaction of the door at the time of its closing causes the door to move slightly toward an opening side. As a result of this, a state will occur in which the distal end portion of the plunger (6) is not fully engaged with the rest notch (15) of the wheel (9), or the engagement piece (50a) of the lock lever (50) is not fully engaged with the locking step (1d) of the drive cam (1). Also, during the process of the unlocking motion of the wheel (9) and the drive cam (1), as the door moves slightly toward the opening side, a state will occur in which the distal end portion of the plunger (6) is not fully disengaged from the rest notch (15) of the wheel (9), or the engagement piece (50a) of the lock lever (50) is not fully disengaged from the locking step (1d) of the drive cam (1).

At this moment, the distal end portion of the plunger (6) is inserted halfway through the rest notch (15) of the wheel (9) and is balanced with a friction force. Similarly, the engagement piece (50a) of the lock lever (50) is inserted halfway through the locking step (1d) of the drive cam (1) and is balanced with a friction force. Here, in the case that a plurality of lock contacts are provided, since ON/OFF switching timing of the respective contacts differ from each other, there is a possibility that incoincidence of the contacts occurs in a balance with the friction force. Since the machine regards such incoincidence as malfunction, each time incoincidence of the contacts frequently occurs, the machine stops, which decreases working efficiency.

The present invention has been made in view of these circumstances and its object is to prevent incoincidence of contacts from occurring in a safety switch.

Other objects and advantages of the present invention will be obvious and appear hereinafter.

Means of Achieving the Objects

In one aspect, the present invention is a safety switch that switches a contact by cooperation of an actuator and a switch body. The switch body comprises a cam that is adapted to rotate by insertion of the actuator, an operating part that switches the contact according to rotation of the cam, and a locking part that is provided movably toward and away from the cam such that the locking part takes a lock position in which it locks rotation of the cam and an unlock position in which it unlocks a lock state of the cam. The locking part includes a bulge that protrudes toward the cam at a portion of its cam contact surface. The cam contact surface is adapted to contact the cam when the actuator moves in a drawing-out direction in an intermediate position between the lock position and the unlock position.

According to the present invention, by inserting the actuator into the switch body, the cam rotates and the operating part switches the contact according to rotation of the cam.

At the time of locking motion of the cam, the locking part is going to move to the lock position. At this time, when the actuator moves in the drawing-out direction in the intermediate position between the unlock position and the lock position and the cam comes into contact with the cam contact surface of the locking part, it is only a part of an area with the protrusion that protrudes toward the cam on the cam contact surface of the locking part. An area other than the protrusion on the cam contact surface does not protrude toward the cam. Thereby, the locking part can smoothly pass the intermediate position between the unlock position and the lock position in the course of locking motion. As a result, the locking part can be prevented from being stopped by the friction with the cam in the middle of moving to the lock position and incoincidence of contacts can thus be prevented from occurring.

Also, at the time of unlocking motion of the cam, the locking part is going to move to the unlock position. At this time, when the actuator moves in the drawing-out direction in the intermediate position between the lock position and the unlock position and the cam comes into contact with the cam contact surface of the locking part, it is only a part of the area with the protrusion that protrudes toward the cam on the cam contact surface of the locking part. An area other than the protrusion on the cam contact surface does not protrude toward the cam. Thereby, the locking part can smoothly pass the intermediate position between the lock position and the unlock position in the course of unlocking motion. As a result, the locking part can be prevented from being stopped by the friction with the cam in the middle of moving to the unlock position and incoincidence of contacts can thus be prevented from occurring.

The bulge may have a first planar surface and a second planar surface that intersect each other.

The locking part may be supported rotatably and a distance from a rotational center of the locking part to the first and second planar surfaces may be set such that the distance from the rotational center of the locking part to a boundary between the first and second planar surfaces is maximized.

The bulge may have an arcuate surface formed of a single or a plurality of arcs.

The cam may have a convex portion and the bulge of the locking part may travel while abutting on the convex portion as the locking part moves through the intermediate position between the lock position and the unlock position.

The locking part may be elastically supported through a gap that is adapted to absorb an interference with the convex portion of the cam.

The locking part may be rotatably supported and its supporting axis may be elastically supported through a radial gap.

In another aspect, the present invention is a safety switch that switches a contact by cooperation of an actuator and a switch body. The switch body comprises a cam that is adapted to rotate by insertion of the actuator, an operating part that switches the contact according to rotation of the cam, and a locking part that is provided movably toward and away from the cam such that the locking part takes a lock position in which it locks rotation of the cam and an unlock position in which it unlocks a lock state of the cam. The locking part is elastically supported through a gap.

According to the present invention, by inserting the actuator into the switch body, the cam rotates and operating part switches the contact according to rotation of the cam At the time of locking motion of the cam, the locking part is going to move to the lock position. At this time, when the actuator moves in the drawing-out direction in the intermediate position between the unlock position and the lock position and a pressing force from the cam acts onto the locking part, as the locking part is elastically supported through the gap, the locking part can smoothly pass the intermediate position between the unlock position and the lock position in the course of locking motion. As a result, the locking part can be prevented from being stopped by the friction with the cam in the middle of moving to the lock position and incoincidence of contacts can thus be prevented from occurring.

Also, at the time of unlocking motion of the cam, the locking part is going to move to the unlock position. At this time, when the actuator moves in the drawing-out direction in the intermediate position between the lock position and the unlock position and a pressing force from the cam acts onto the locking part, as the locking part is elastically supported through the gap, the locking part can smoothly pass the intermediate position between the lock position and the unlock position in the course of unlocking motion. As a result, the locking part can be prevented from being stopped by the friction with the cam in the middle of moving to the unlock position and incoincidence of contacts can thus be prevented from occurring.

Effects of the Invention

As above-mentioned, according to the present invention, incoincidence of the contacts in the safety switch can be prevented from occurring.

BEST MODE FOR CARRYING OUT THE INVENTION

Figure 1:
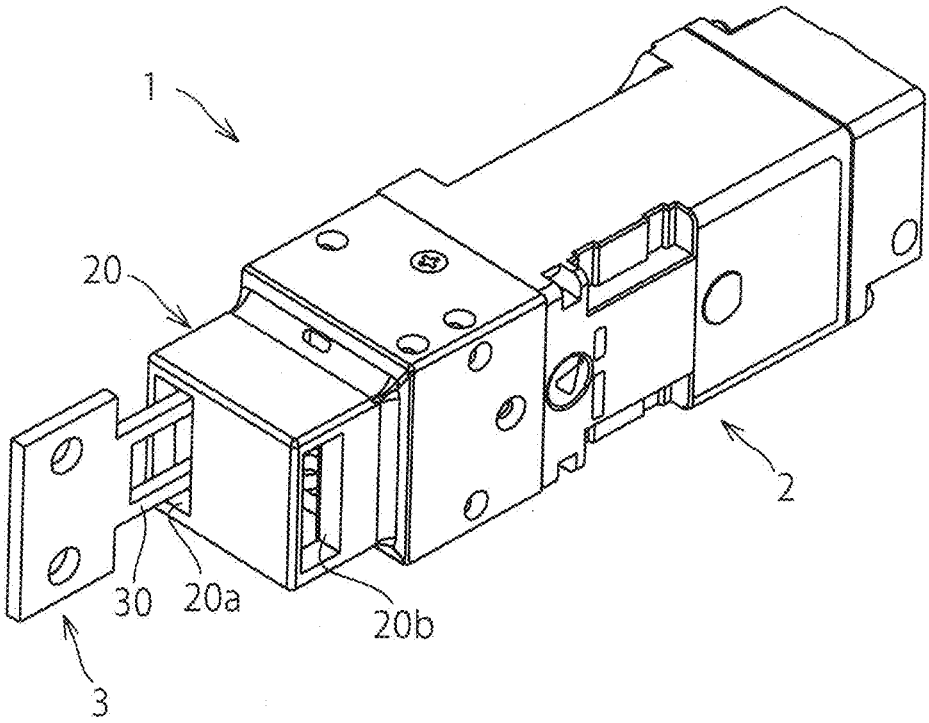
FIG. 1 is a general perspective view of the safety switch according to an embodiment of the present invention, illustrating the state in which the actuator is inserted into the switch body.
Figure 2:
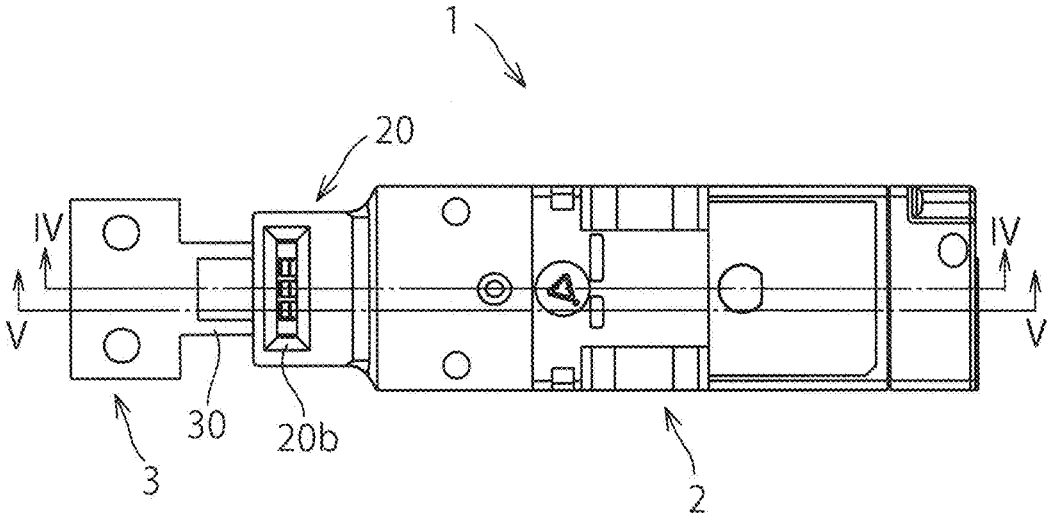
FIG. 2 is a front elevational view of the safety switch of FIG. 1.
Figure 3:
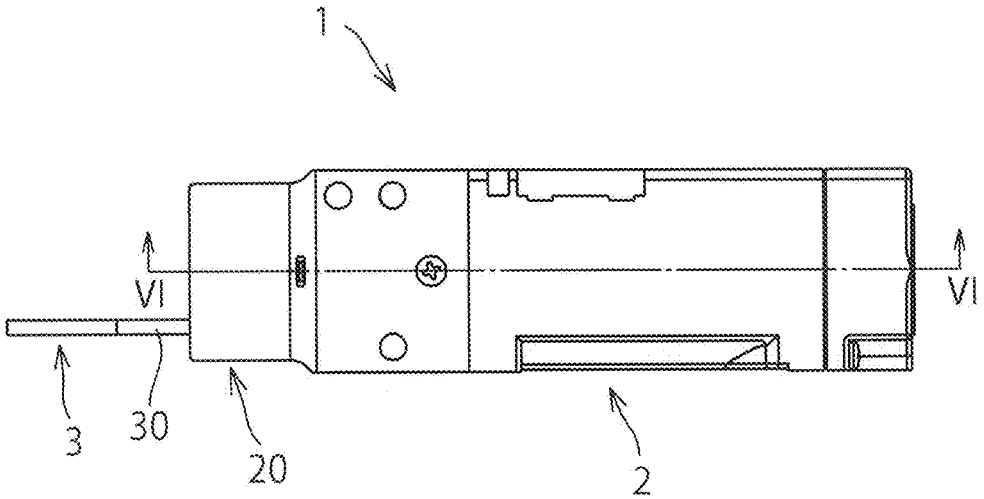
FIG. 3 is a bottom view of the safety switch of FIG. 1.
Figure 4:
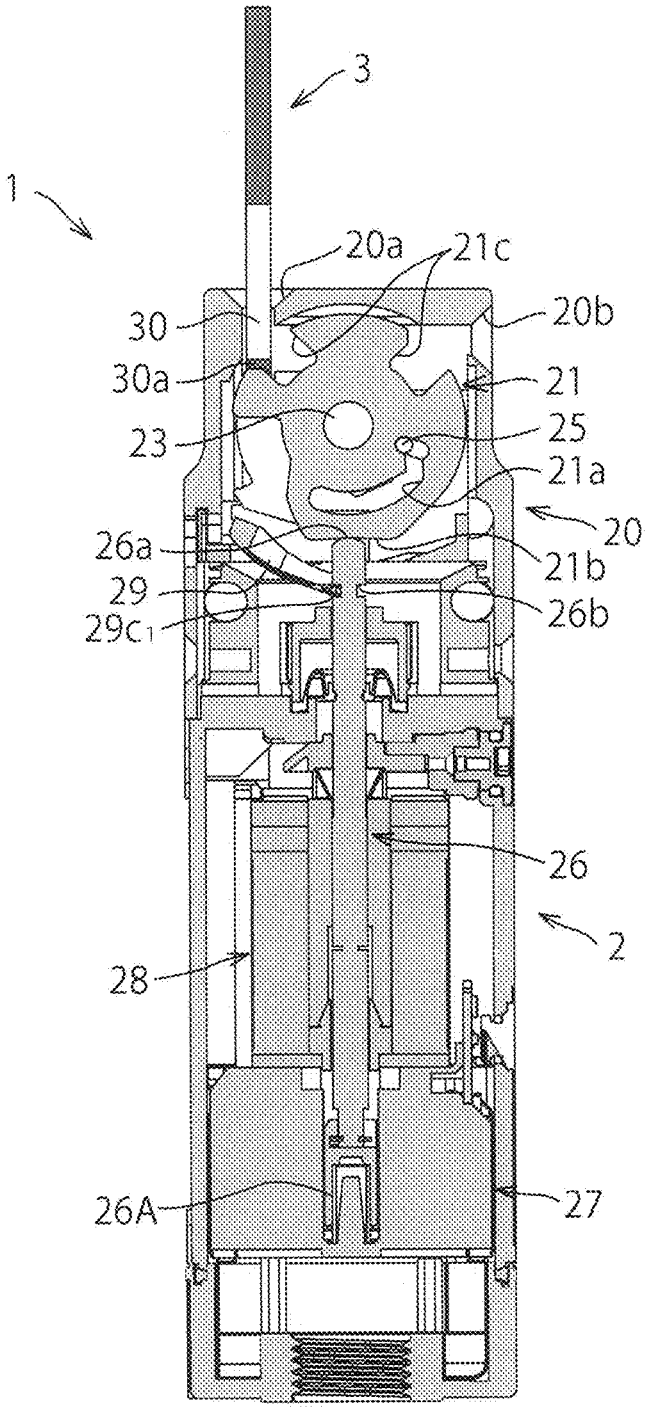
FIG. 4 is a longitudinal sectional view of FIG. 2 taken along line IV-IV.
Figure 5:
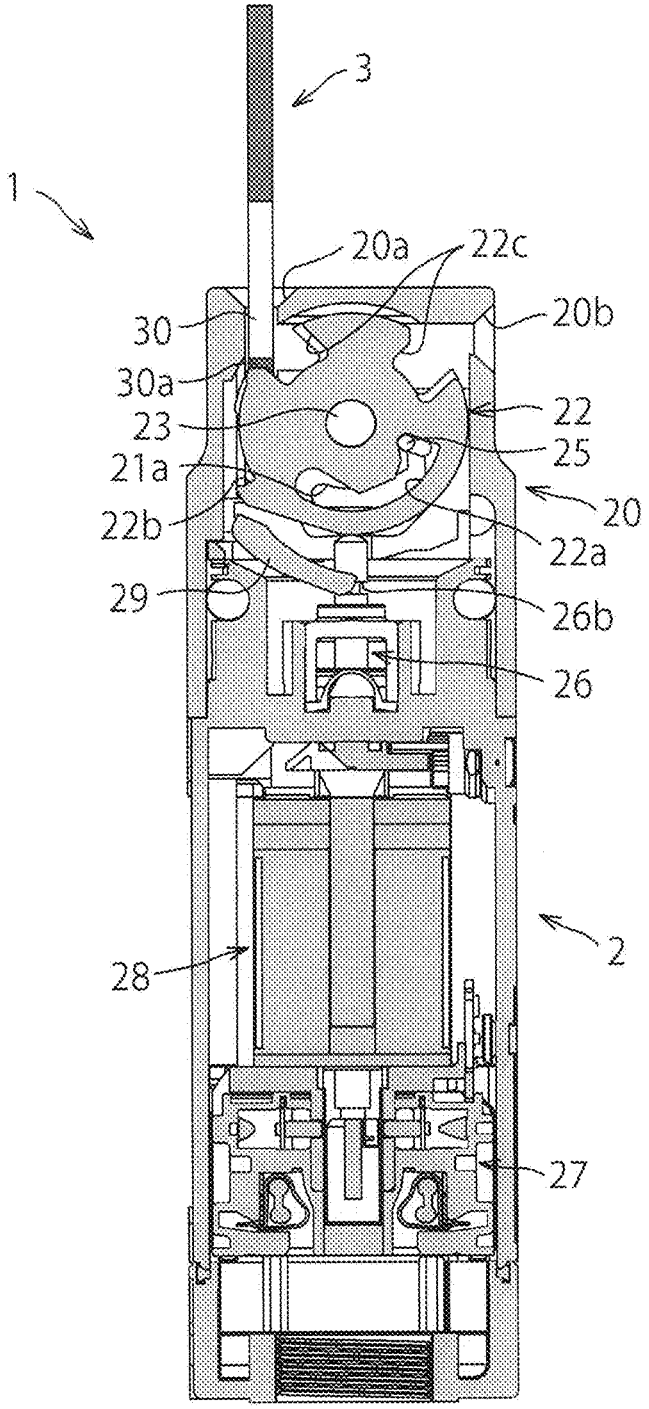
FIG. 5 is a longitudinal sectional view of FIG. 2 taken along line V-V.
Figure 6:
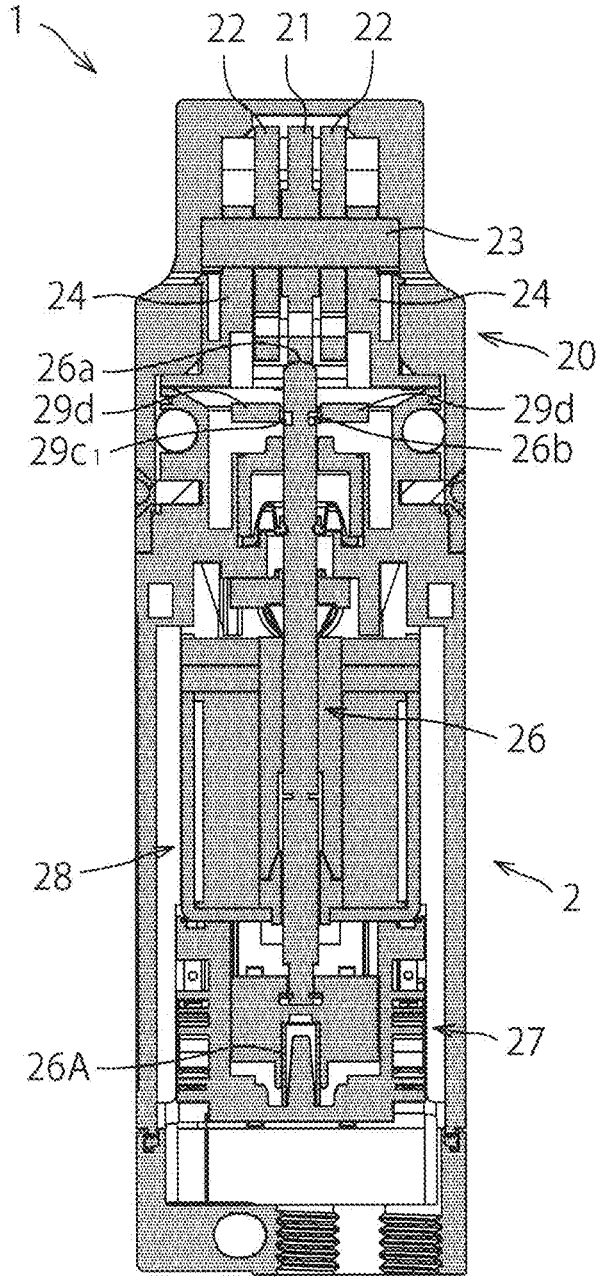
FIG. 6 is a longitudinal sectional view of FIG. 3 taken along line VI-VI.
Figure 7:
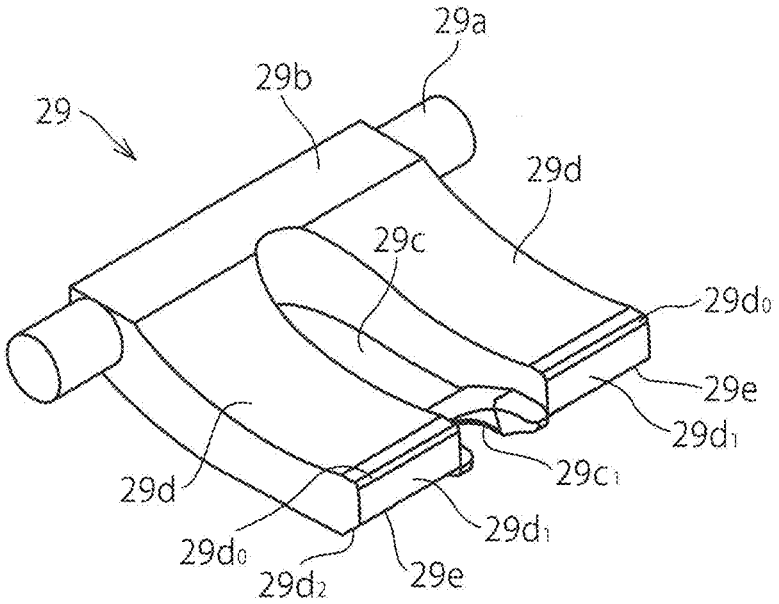
FIG. 7 is a general perspective view of the lock lever provided inside the switch body of the safety switch of FIG. 1.
Figure 8:
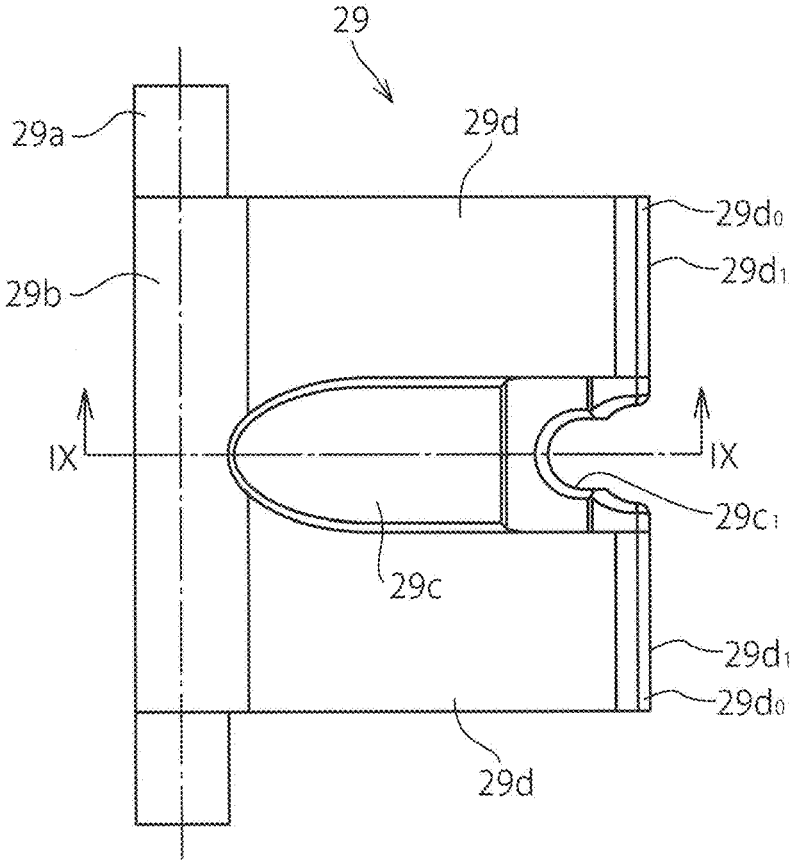
FIG. 8 is a top plan view of the lock lever of FIG. 7.

The present invention will now be described in detail with reference to embodiments thereof as illustrated in the accompanying drawings. Referring to the drawings, FIGS. 1 to 22A show a safety switch according to an embodiment of the present invention. In these drawings, FIGS. 1 to 3 illustrate an external appearance of the safety switch. FIGS. 4 to 6 illustrate an internal structure of the safety switch, whose sectional area is colored in gray. FIGS. 7 to 10 illustrate an external appearance or a sectional shape of a locking lever. FIGS. 11 to 22A are internal structural drawings or the detailed views for explaining the motion of the safety switch.

As shown in FIGS. 1 to 3, the safety switch 1 includes a switch body 2 disposed at a wall or a fixed door (not shown) for instance, and an actuator 3 disposed at a movable door for instance (not shown) and provided insertable and extractable relative to the switch body 2. The safety switch 1 is structured in such a way as to switch contacts inside the switch body 2 in cooperation with the actuator 3 and the switch body 2.

The switch body 2 has a head portion 20 on one end side. The head portion 20 has one or a plurality of (in this example, two) actuator insertion openings 20*a*, 20*b* into which a distal end portion 30 of the actuator 3 is inserted.

As shown in FIGS. 4 to 6 (especially, FIG. 6), the safety switch 1 has an operating cam 21 and a pair of locking cams 22 disposed on axially opposite sides of the operating cam 21 inside the head portion 20. Both of the cams 21, 22 are plate cams, which are rotatably supported by an axis 23 provided inside the head portion 20. On axially external sides of the locking cams 22, a pair of cam supporting portions 24 are disposed to support each of the locking cams 22 from its side. The axis 23 extends to sidewalls of the head portion 20 through the cam supporting portions 24.

The operating cam 21, shown in FIG. 4, has a guide opening 21*a* that extends through the operating cam 21 in the thickness direction and that extends along the circumferential direction. Similarly, each of the locking cams 22, shown in FIG. 5, has a guide opening 22*a* that extends through the locking cam 22 in the thickness direction and that extends along the circumferential direction. The guide opening 22*a* is disposed at a position that corresponds to the guide opening 21*a*. An axially extending pin 25 is inserted into each of the guide openings 21*a* and 22*a*. Both ends of the pin 25 are supported by each of the cam supporting portions 24 (FIG. 6) and biased toward an inner circumferential side of each of the guide openings 21*a* and 22*a* by a spring (not shown) provided at each of the cam supporting portions 24. According to this constitution, the operating cam 21 and each of the locking cams 22 are rotatable only in the state that the rotation angles coincide with each other.

On the outer circumferential surface of the operating cam 21, shown in FIG. 4, two notches 21*c* are formed and on the outer circumferential surface of each of the locking cams 22, shown in FIG. 5, two notches 22*c* are formed that respectively correspond to each of the notches 21*c* of the operating cam 21. Prior to insertion of the distal end portion 30 of the actuator 3 deeply into the head portion 20 (see FIGS. 4 and 5), one of the notches 21*c* and the corresponding notch 22*c* are disposed in the vicinity of the actuator insertion opening 20*a* of the head portion 20, and the other of the notches 21*c* and the corresponding notch 22*c* are disposed in the vicinity of the other actuator insertion opening 20*b* of the head portion 20. The bifurcated distal end portion 30 of the actuator 3 inserted through the actuator insertion opening 20*a* (or 20*b*) of the head portion 20 has a press bar 30*a* at its distal end that comes into contact with a wall surface of each of the notches 21*c*, 22*c* of the operating cam 21 and each of the locking cams 22 to rotate both of the operating cam 21 and the locking cams 22.

Inside the switch body 2, shown in FIGS. 4 to 6, an operating rod (or an operating part) 26 is disposed extending in a longitudinal direction of the switch body 2. A distal end of the operating rod 26 extends to the head portion 20 on one side of the switch body 2 and a rear end of the operating rod 26 extends toward the other side of the switch body 2. The operating rod 26 is biased to the forwarding side toward the head portion 20 by a spring 26A and a convex arc surface 26*a* of the distal end of the operating rod 26 is in elastically contact with an outer circumferential surface 21*b* of the operating cam 21. Thereby, at the time of rotation of the operating cam 21, the operating rod 26 reciprocates with the distal end of the operating rod 26 following the motion of the outer circumferential surface 21*b* of the operating cam 21. The rear end of the operating rod 26 is coupled to a contact block 27 provided on the other end side of the switch body 2. Also, around a substantially central part of the operating rod 26, a solenoid 28 is provided. The operating rod 26 is adapted to move rearwardly toward the opposite side end of the switch body 2, that is, the distal end of the operating rod 26 is adapted to move away from the operating cam 21, by energization of the solenoid 28. The contact block 27 is provided with a lock contact and an unlock contact that switches contacts by turning on and off the contacts according to the movement of the operating rod 26.

A locking lever (or locking part) 29 is disposed beside the distal end of the operating rod 26 inside the head portion 20. As shown in FIGS. 7 to 10, the locking lever 29 includes a proximal portion 29*b* with a cylindrical supporting shaft 29*a*, a pair of lever portions 29*d* that extend in a bifurcated shape from the proximal portion 29*b* and that are coupled to each other through a thin plate portion 29*c*, and a semi-circular engagement recess $29c_1$ formed at a distal end of the thin plate portion 29*c*. The locking lever 29 is a member that extends from the proximal portion 29*b* to the distal end in an arc-shape (see FIGS. 5 and 9) and is downwardly convexly curved.

Figure 9:
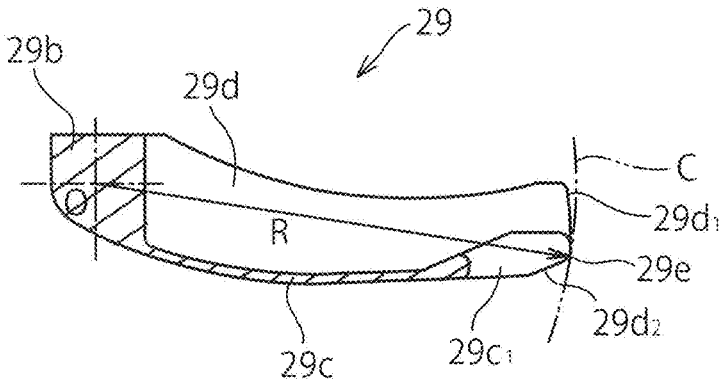
FIG. 9 is a longitudinal sectional view of FIG. 8 taken along line IX-IX.
Figure 10:
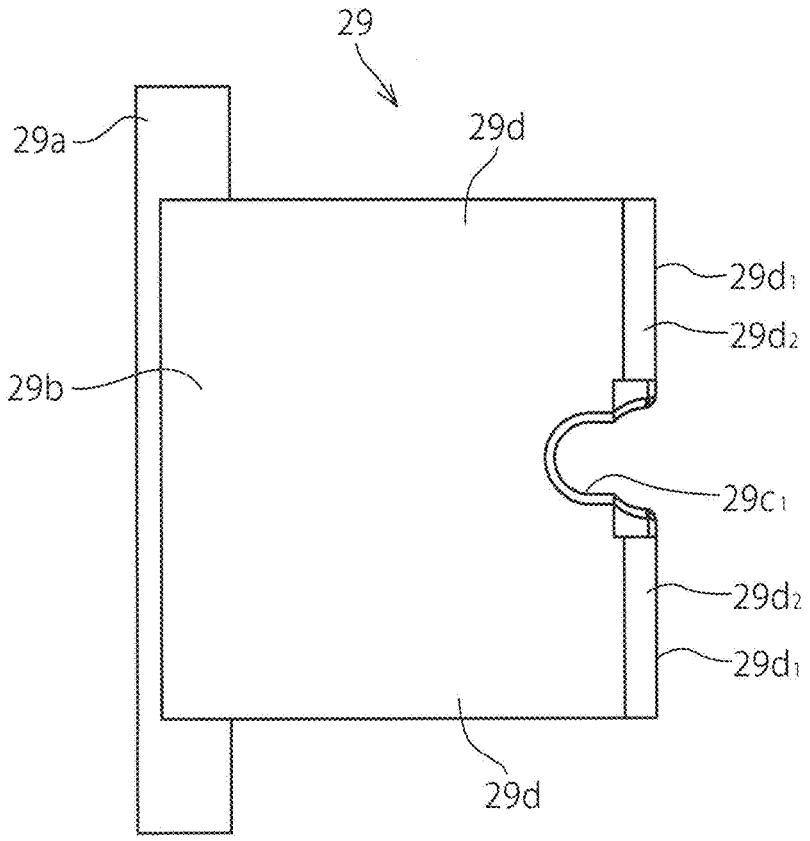
FIG. 10 is a bottom view of the lock lever of FIG. 7.

A distal end surface of each of the lever portions 29*d*, shown in FIGS. 7 to 10, has an upright first planar surface $29d_1$ and a second planar surface $29d_2$ that intersects the first planar surface $29d_1$ diagonally, such that thereby the distal end surface is formed in an angular shape. As shown in FIG. 9, when drawing a circular arc C that has a center at a center O of the supporting shaft 29*a* and that has a radius of a distance R extending from the center O to a ridge line 29*e* which is a boundary between the first planar surface $29d_1$ and the second planar surface $29d_2$, both of the first and second planar surfaces $29d_1$, $29d_2$ are disposed inside the circular arc C. That is, regarding the distance from the center O to the first and second planar surfaces $29d_1$, $29d_2$, the distance R from the center O to the ridge line 29*e*, or a boundary between the first planar surface $29d_1$ and the second planar surface $29d_2$ is the greatest. Also, regarding a length of the first and second planar surfaces $29d_1$, $29d_2$ in the direction intersecting the ridge line 29*e*, the first planar surface $29d_1$ is longer than the second planar surface $29d_2$.

The supporting shaft 29*a* of the locking lever 29 is supported rotatably by the cam supporting portion 24 (FIG. 6) in the head portion 20 and each of the lever portions 29*d* faces the corresponding locking cam 22 (see FIG. 6). Thereby, the locking lever 29 is rotatable around a center axis line of the supporting shaft 29*a* and each of the lever portions 29*d* is thus movable toward and away from the locking cam 22. The outer circumferential surface of each of the locking cams 22, shown in FIG. 5, has an engagement surface 22*b* formed thereon such that the distal end surface of each of the lever portions 29*d* comes into contact and engagement with the engagement surface 22*b* at the time of rotation of the locking lever 29. Also, the engagement recess $29c_1$ of the locking lever 29, shown in FIG. 6, is in direct contact and engagement with a circumferential groove 26*b* formed on the outer circumferential surface in the vicinity of the distal end of the operating rod 26. Thereby, the locking lever 29 is directly coupled with the operating rod 26 such that the locking lever 29 is movably linked with and thus rotatable according to the motion of the operating rod 26.

In this manner, rotation of the locking lever 29 according to reciprocation (i.e. forward/rearward movement) of the operating rod 26 causes the locking lever 29 to be located at a lock position to lock rotation of the locking cam 22 and at an unlock position to unlock the lock state of the locking cam 22 (described in detail below).

Then, operation of the above-mentioned safety switch 1 will be explained.

Here, first, operation when the actuator 3 is inserted into the head portion 20 of the switch body 2 at the time of closing the door will be explained in reference to FIGS. 11 to 13A. In these drawings, coloring in gray or hatching to designate a sectional portion is omitted for illustration purposes.

Figure 11:
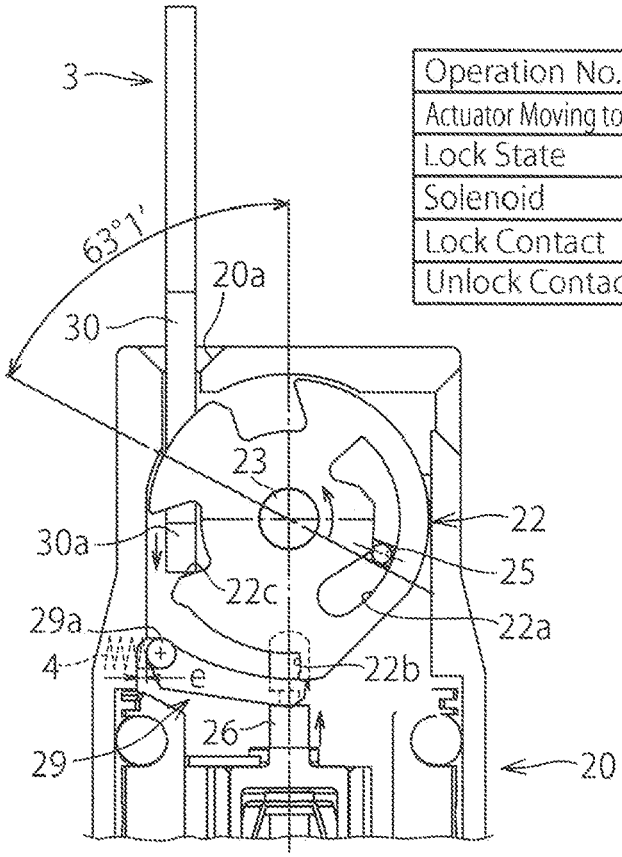
FIG. 11 is a schematic illustrating operation of the safety switch of FIG. 1 in time-series manner along with FIGS. 12 and 13 at the time of insertion of the actuator, which shows the actuator along with the internal structure of the head portion of the switch body.
Figure 11A:
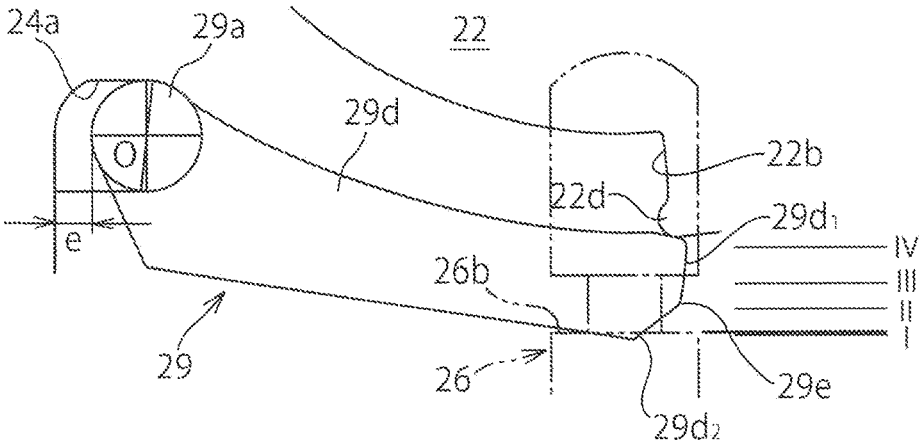
FIG. 11A is an enlarged view of the locking lever portion of FIG. 11.
Figure 12:
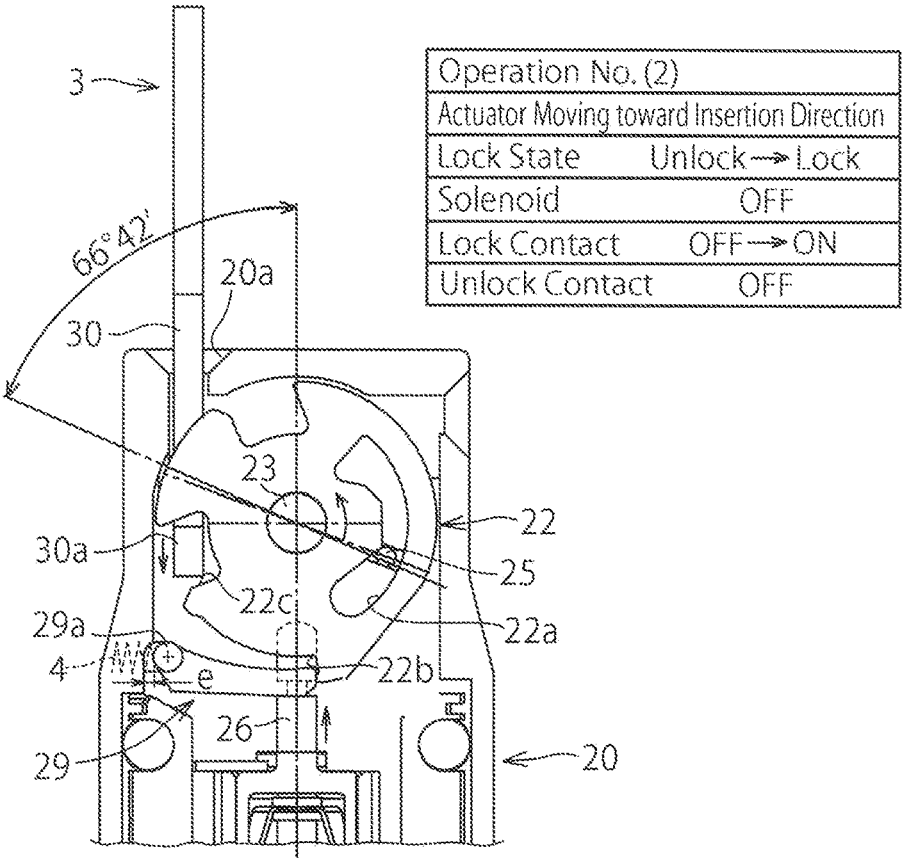
FIG. 12 is a schematic illustrating operation of the safety switch of FIG. 1 in time-series manner along with FIGS. 11 and 13 at the time of insertion of the actuator, which shows the actuator along with the internal structure of the head portion of the switch body.
Figure 12A:
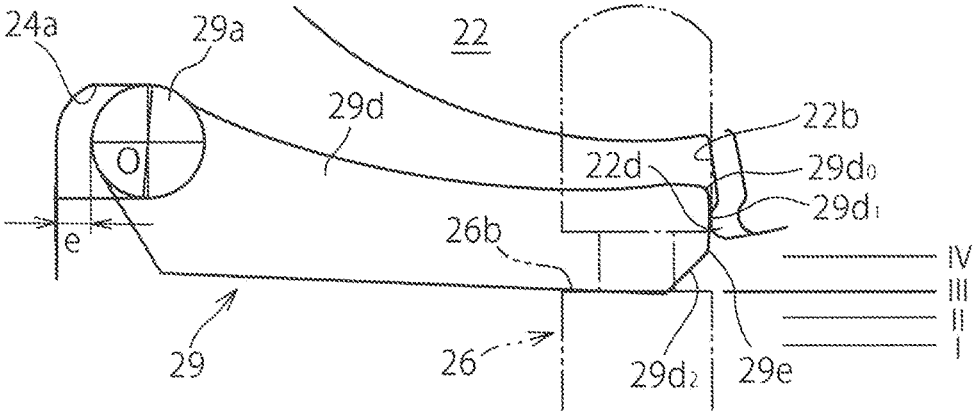
FIG. 12A is an enlarged view of the locking lever portion of FIG. 12.
Figure 13:
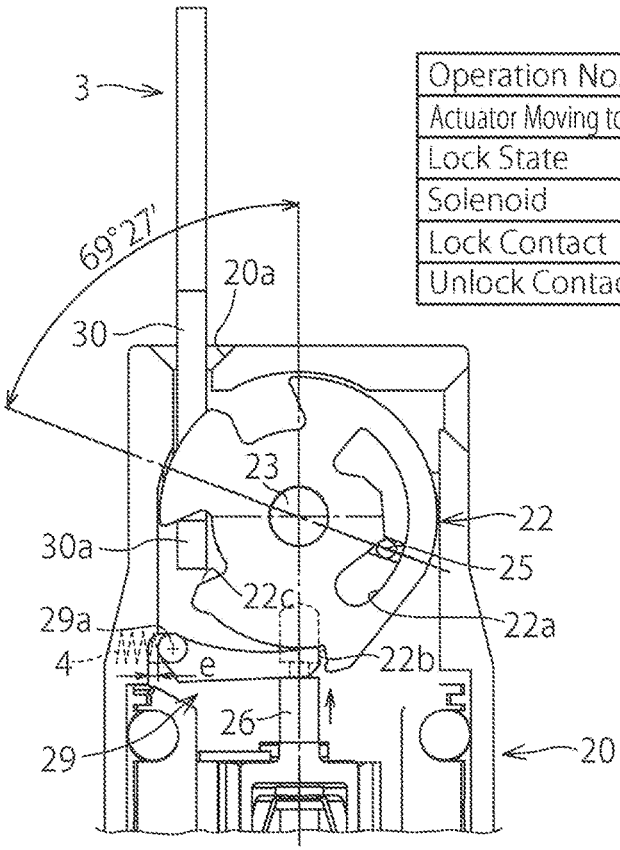
FIG. 13 is a schematic illustrating operation of the safety switch of FIG. 1 in time-series manner along with FIGS. 11 and 12 at the time of insertion of the actuator, which shows the actuator along with the internal structure of the head portion of the switch body.
Figure 13A:
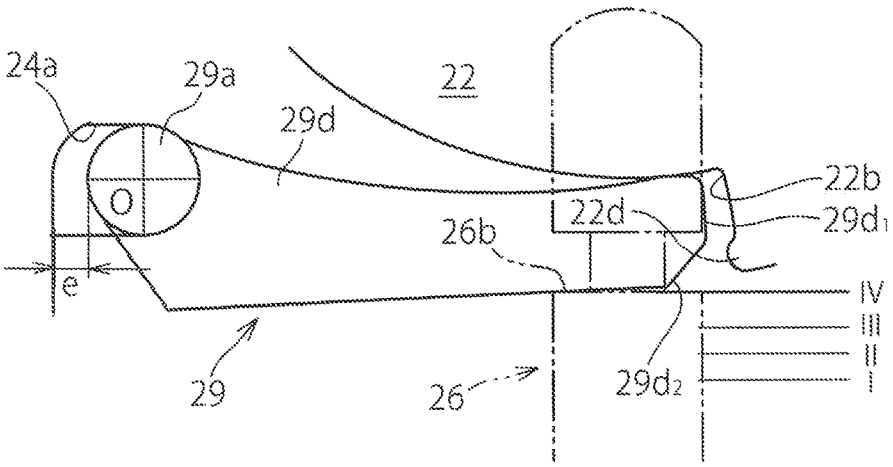
FIG. 13A is an enlarged view of the locking lever portion of FIG. 13.

As shown in FIGS. 11A, 12A and 13A, the supporting shaft 29*a* of the locking lever 29 is housed via a radial gap e in an elongated hole 24*a* formed in the cam supporting portion 24 (FIG. 6) and is biased at all times toward the side of the operating rod 26 that is one side of the elongated hole 24*a*. That is, the locking lever 29 is elastically supported via the gap e in the elongated hole 24*a*. At this time, a spring force by the spring 26A (FIGS. 4 and 6) always acts onto the operating rod 26, which is always biased upwardly in the forward direction. Thereby, the locking lever 29 in direct contact and directly coupled with the operating rod 26 is biased at all times to rotate upwardly around the fulcrum O.

In FIGS. 11A, 12A and 13A, the position of a wall surface of the circumferential groove 26*b* formed at the operating rod 26 designates a rotational position of the locking lever 29 and a contact state of the lock/unlock contacts in the contact block 27 (FIGS. 4 to 6), which are defined by the axial position of the operating rod 26 that reciprocates in the axial direction. In the drawings, "I" designates an unlock position of the locking lever 29, "II" an ON/OFF switching point of the unlock contact, "III" an ON/OFF switching point of the lock contact, and "IV" a lock position of the locking lever 29. Also, on the engagement surface 22*b* of the locking cam 22, at a position near the outer circumferential surface of the locking cam 22, there is formed a protrusion or protrusion (or a convex portion) 22*d* that has a semi-circular cross sectional shape and that extends along the engagement surface 22*b* into the page.

Operation No. (1) shown in FIG. 11 illustrates the state in which the actuator 3 is inserted into the actuator insertion opening 20*a* of the head portion 20 of the switch body 2 and the press bar 30*a* at the distal end of the actuator 3 causes the locking cam 22 to rotate in the counter-clockwise direction. In FIG. 11A showing the enlarged view of the locking lever 29 portion, the distal end of the locking lever 29 comes into contact with the protrusion 22*d* on the engagement surface 22*b* of the locking cam 22 from below and the locking lever 29 is located at the unlock position I (see the bold line in FIG. 11A) where the locking cam 22 is not locked. In the unlock position I, as shown in the table of FIG. 11, the lock state of the locking cam 22 is turned "Unlock", the solenoid 28 (FIG. 5) is turned "OFF", the lock contact is turned "OFF", and the unlock contact is turned "ON".

Operation No. (2) shown in FIG. 12 illustrates the state in which the locking cam 22 is further rotated from the state of the operation No. (1) in FIG. 11. When the protrusion 22*d* on the engagement surface 22*b* of the locking cam 22 passes through a corner portion $\mathbf{29}d_0$ on an upper side of the distal end of the locking lever 29 at the time of rotation of the locking cam 22, the locking lever 29 rotates upwardly as shown in FIG. 12A because the locking lever 29 is biased upwardly around the fulcrum O. During rotation of the locking lever 29, the first planar surface $\mathbf{29}d_1$ at the distal end of the locking lever 29 slides along the protrusion 22*d* of the locking cam 22. At this time, since the locking cam 22 is in the middle of rotation, a sliding resistance between the first planar surface $\mathbf{29}d_1$ of the locking lever 29 and the protrusion 22*d* of the locking cam 22 is small and an upward rotation of the locking lever 29 is thus conducted smoothly. As a result, the locking lever 29 does not stop in the middle of the upward rotation of the locking lever 29 and thus the first planar surface $\mathbf{29}d_1$ of the locking lever 29 is going to readily get over the protrusion 22*d* of the locking cam 22.

In the state shown in FIGS. 12 and 12A, the locking lever 29 is located at the ON/OFF switching point III of the lock contact (see the bold line in FIG. 12A). In the ON/OFF switching point III of the lock contact, as shown in the table of FIG. 12, the lock state of the locking cam 22 is in the state of shifting from "Unlock to Lock", the solenoid 28 (FIG. 5) is "OFF", the lock contact is in the state of shifting from "OFF to ON", and the unlock contact is turned "OFF".

Operation No. (3) shown in FIG. 13 illustrates the state in which the locking cam 22 is further rotated from the state of the operation No. (2) in FIG. 12 to come into contact with the press bar 30*a* of the actuator 3 and stops rotating. At this time, the first planar surface $\mathbf{29}d_1$ of the locking lever 29, shown in FIG. 13A, gets over the protrusion 22*d* of the locking cam 22 and moves to the position where the first planar surface $\mathbf{29}d_1$ of the locking lever 29 faces the engagement surface 22*b* of the locking cam 22.

In this state, the locking lever 29 is located at the lock position IV to lock the locking cam 22 (see the bold line in FIG. 13A). In the lock position IV, as shown in the table of FIG. 13, the lock state of the locking cam 22 is turned "Lock", the solenoid 28 (FIG. 5) is "OFF", the lock contact is turned "ON", and the unlock contact is "OFF".

Then, operation when the door bounds at the time of closing the door and the actuator 3 inserted into the head portion 20 is pulled in the drawing-out direction will be explained in reference to FIGS. 14 to 18A. In these drawings, coloring in gray or hatching to designate a sectional portion is omitted for illustration purposes.

Figure 14:
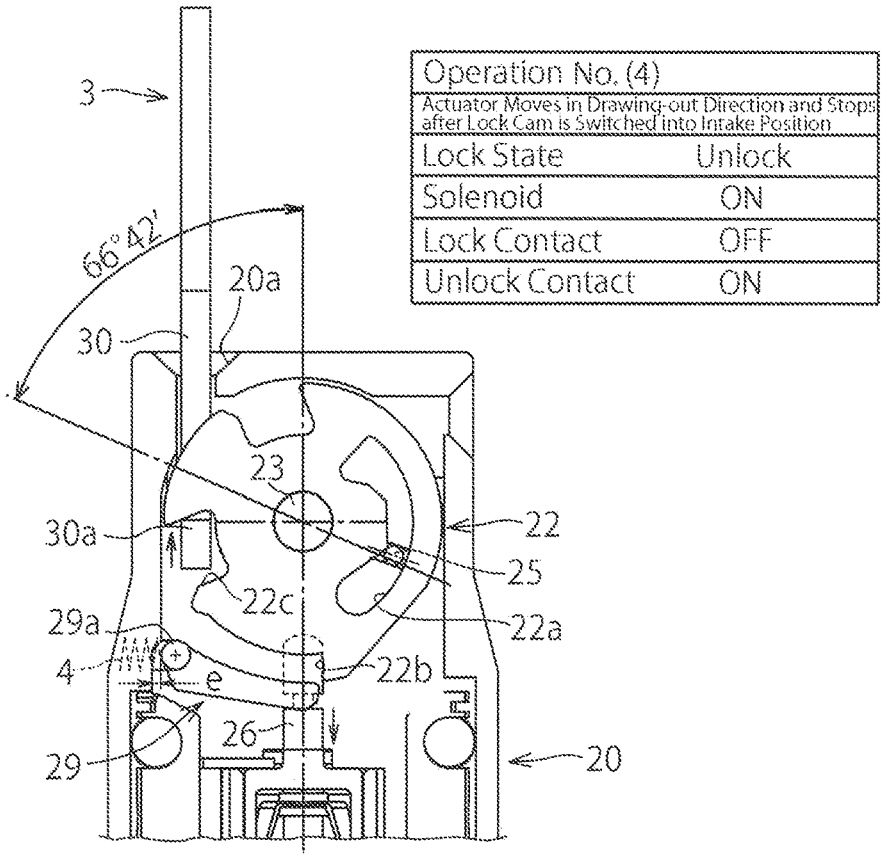
FIG. 14 is a schematic illustrating the state of the actuator of the safety switch of FIG. 1 that moves in the drawing-out direction and has stopped after the locking cam at the upper part of the switch body was switched to the intake position at the time of insertion of the actuator.
Figure 14A:
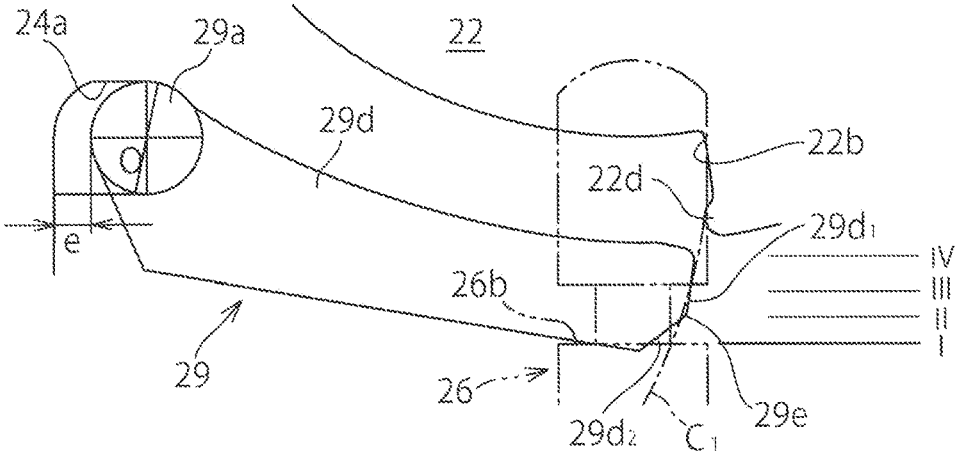
FIG. 14A is an enlarged view of the locking lever portion of FIG. 14.

Operation No. (4) shown in FIG. 14 illustrates the state in which the actuator 3 moves in the drawing-out direction and stops after the locking cam 22 have been switched into the actuator intake side at the time of insertion of the actuator 3. At this time, the solenoid 28 (FIG. 5) is turned "ON" (see the table in FIG. 14), and as shown in FIG. 14A, downward movement of the operating rod 26 causes the locking lever 29 to rotate downwardly. In this state, the locking lever 29 is located at the unlock position I (see the bold line in FIG. 14A), the lock state of the locking cam 22 is turned "Unlock", the lock contact is turned "OFF", and the unlock contact is turned "ON" (see the table in FIG. 14).

Figure 14B:
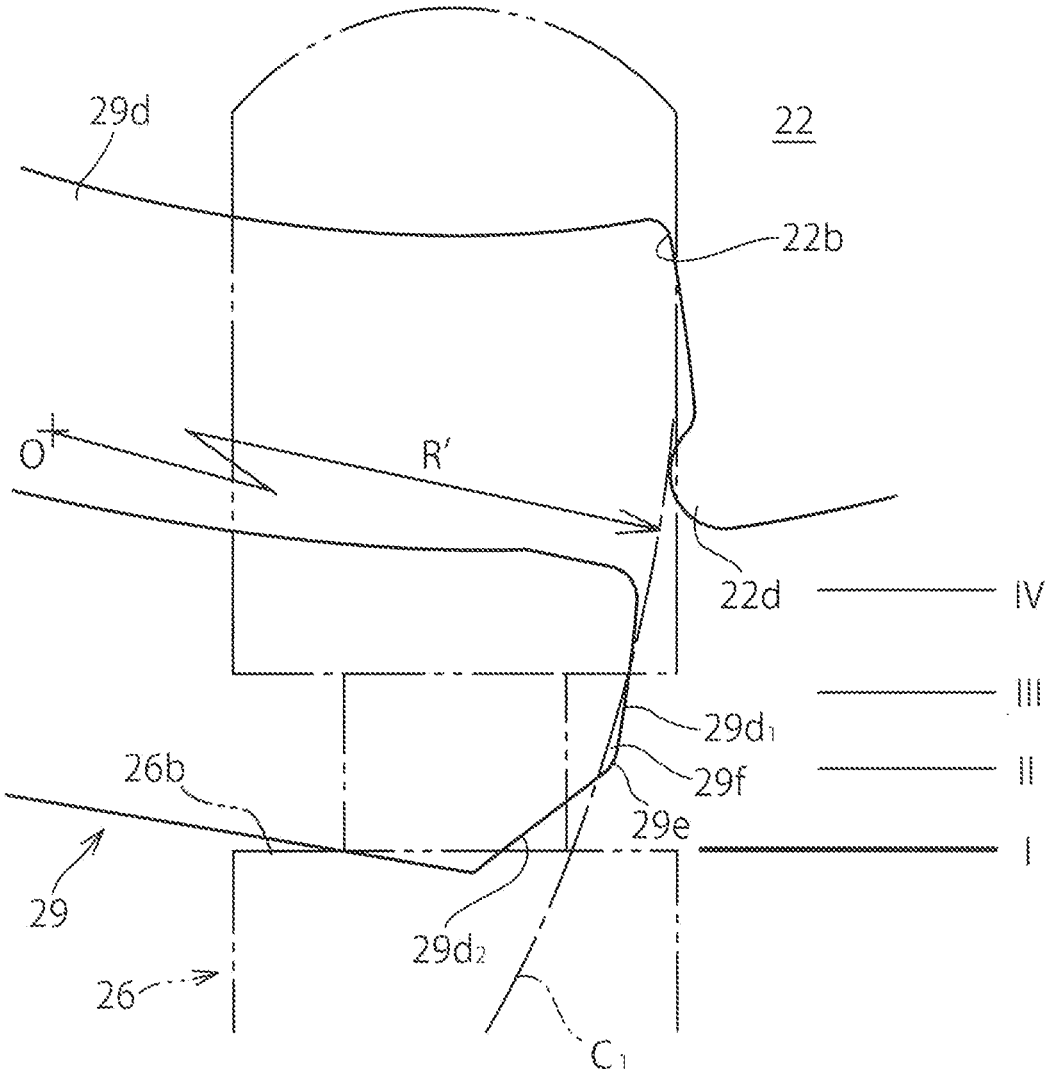
FIG. 14B is a partially detailed view of FIG. 14A.

As shown in FIG. 14B, a partially detailed view of FIG. 14A, when drawing a circular arc $C_1$ that has a center at the rotational center O of the locking lever 29 and that is tangent to the protrusion 22*d* of the locking cam 22, a radius R' of the circular arc $C_1$ is smaller than the radius R (FIG. 9), i.e. R'<R. A triangular area 29*f* that includes the ridge line 29*e* on the distal end surface of the locking lever 29 and a portion of the first and second planar surfaces $\mathbf{29}d_1$, $\mathbf{29}d_2$ is a bulge that protrudes outside the circular arc $C_1$.

Figure 15:
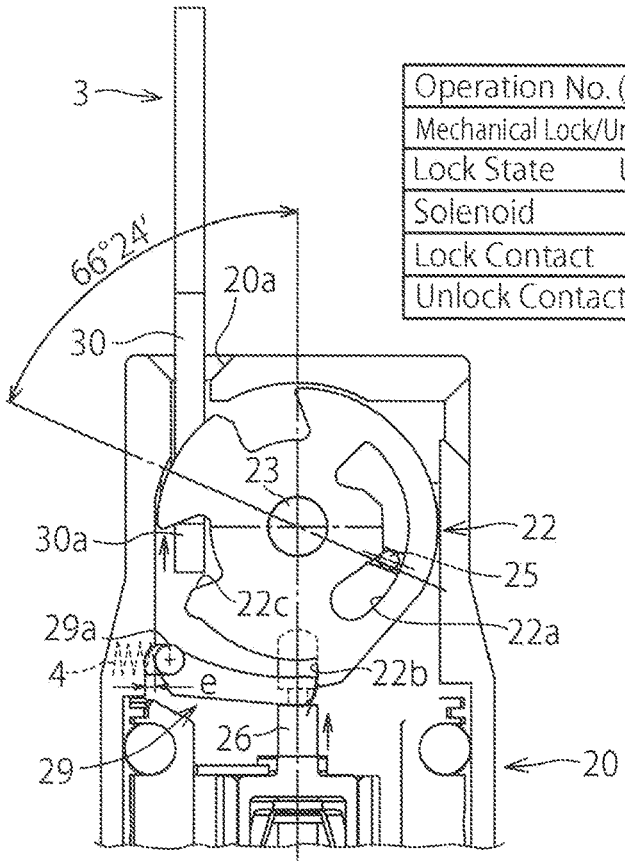
FIG. 15 is a schematic illustrating operation of the safety switch of FIG. 1 in time-series manner along with FIGS. 16 to 18, in which while the actuator moves in the drawing-out direction the locking lever is transferred from the unlock position to the lock position after the locking cam at the upper part of the switch body has been switched to the intake position at the time of insertion of the actuator.

Operation No. (5) shown in FIG. 15 illustrates the state immediately after the first planar surface $\mathbf{29}d_1$ of the locking lever 29 comes into contact with the protrusion 22*d* of the locking cam 22 when the solenoid 28 (FIG. 5) turns "OFF" from the state shown in FIG. 14 (see the table in FIG. 14) and the operating rod 26 is moved upwardly by the spring force to cause the locking lever 29 to rotate upwardly. That is a switching point of mechanical lock/unlock of the locking cam 22.

Figure 15A:
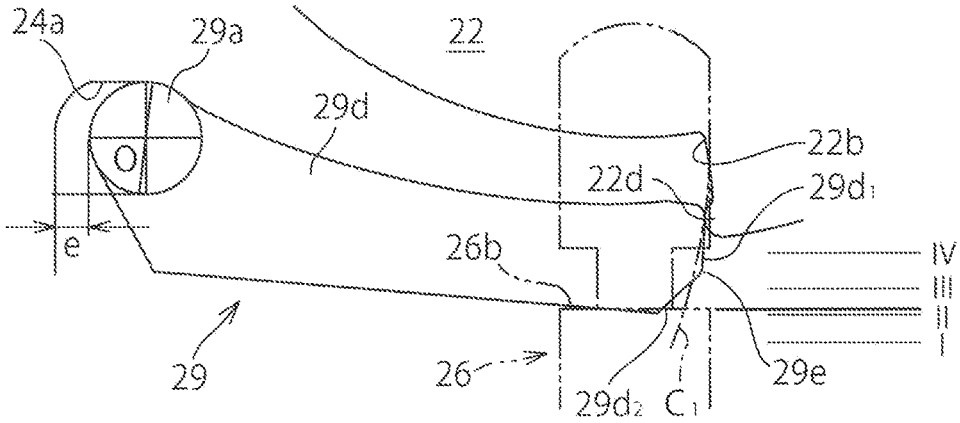
FIG. 15A is an enlarged view of the locking lever portion of FIG. 15.

In this state, the locking lever 29 is located at a position in close proximity to the ON/OFF switching point II of the unlock contact (see the bold line in FIG. 15A). In the ON/OFF switching point II of the unlock contact, as shown in the table of FIG. 15, the lock state of the locking cam 22 is in the state of shifting from "Unlock to Lock", the lock contact is "OFF", and the unlock contact is "ON".

Figure 15B:
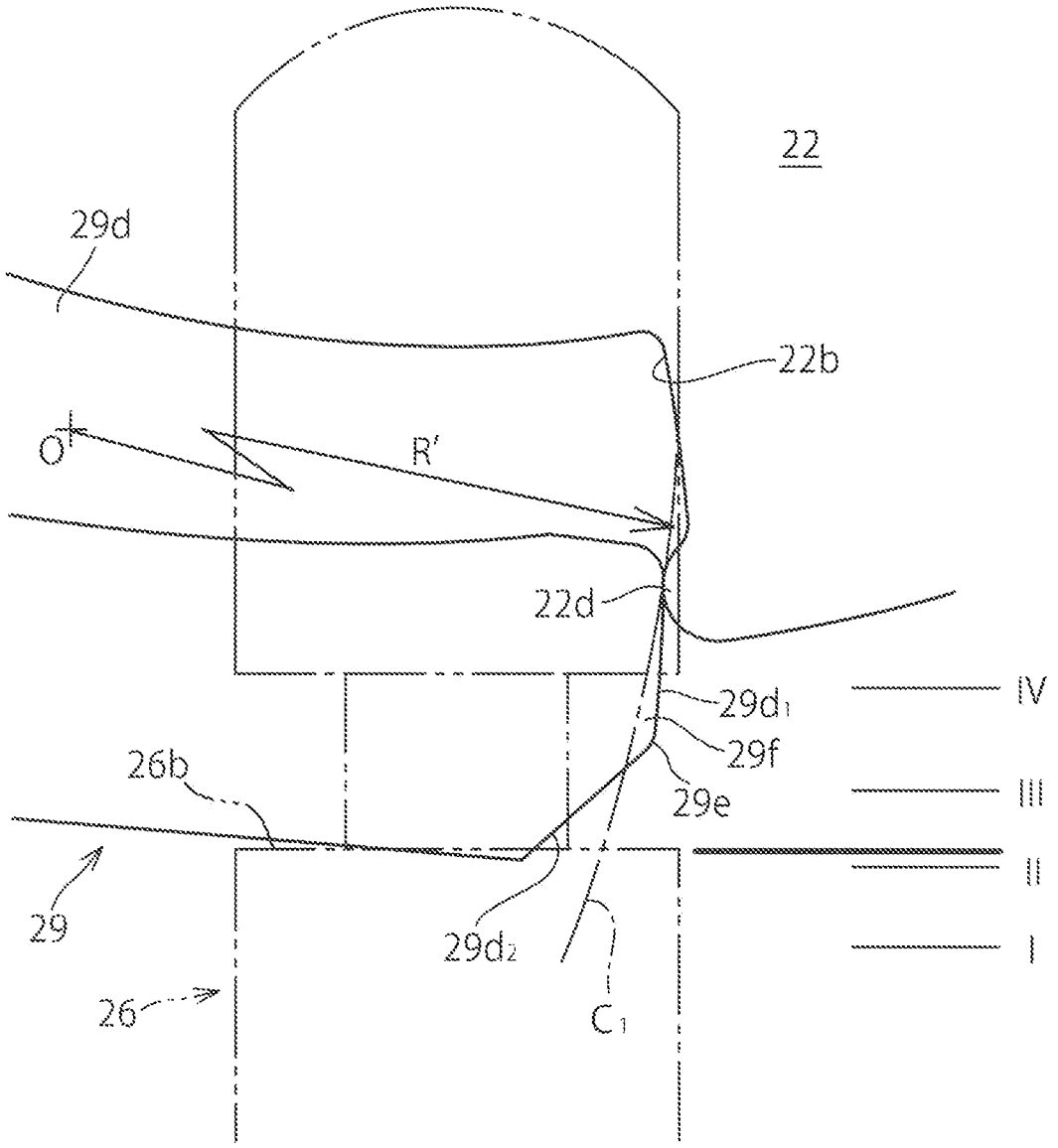
FIG. 15B is a partially detailed view of FIG. 15A.

As shown in FIG. 15B or a partially detailed view of FIG. 15A, in this case as well, similar to FIG. 14B, the bulge 29*f* that protrudes outside the circular arc $C_1$ is formed of a triangular area that contains the ridge line 29*e* on the distal end surface of the locking lever 29 and a portion of the first and second planar surfaces $\mathbf{29}d_1$, $\mathbf{29}d_2$. The bulge 29*f* is an interference region that interferes with the protrusion 22*d* of the locking cam 22 while the locking lever 29 rotates further upwardly.

Figure 16:
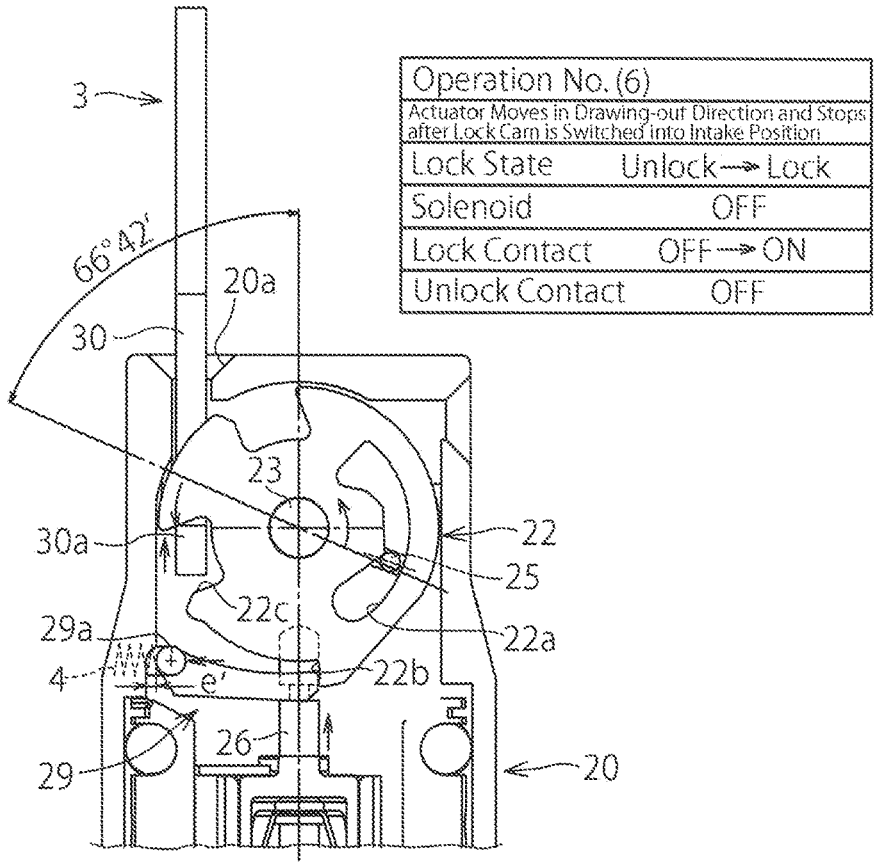
FIG. 16 is a schematic illustrating the state in which the operating rod of the safety switch of FIG. 1 moves further upwardly from the state shown in FIG. 15.
Figure 16A:
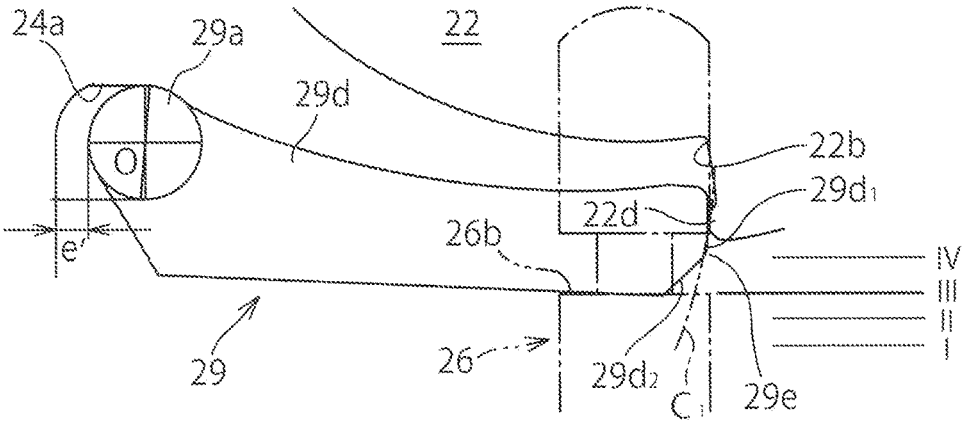
FIG. 16A is an enlarged view of the locking lever portion of FIG. 16.

Operation No. (6) shown in FIG. 16 illustrates the state in which the locking lever 29 rotates further upwardly by slightly releasing the tense state of the actuator 3 in the draw-out direction from the state of the operation No. (5) in FIG. 15. At the time of rotation of the locking lever 29, as shown in FIG. 16A, the first planar surface $\mathbf{29}d_1$ of the distal end of the locking lever 29 slides along the protrusion 22*d* of the locking cam 22 in contact with protrusion 22*d*. At this moment, since the supporting shaft 29*a* of the locking lever 29 is elastically supported in the elongated hole 24*a* via a gap, the locking lever 29 can move to the left in FIG. 16A thus absorbing interference of the protrusion 22*d* of the locking cam 22 with the bulge 29*f* (FIG. 15B) of the distal end of the locking lever 29. In FIG. 16A, the gap e' after interference is smaller than the gap e, that is e'<e. Moreover, when the first planar surface $\mathbf{29}d_1$ of the distal end of the locking lever 29 comes into contact with the protrusion 22*d* of the locking cam 22, it is only a portion of an area with the bulge 29*f* that protrudes outside the circular arc $C_1$ on the distal end surface of the locking lever 29. An area other than the bulge 29*f* on the distal end surface of the locking lever 29 does not protrude outside circular arc $C_1$. Thereby, rotation of the locking lever 29 in the upward direction can be conducted smoothly. As a result, the locking lever 29 does not stop halfway at the time of rotation in the upward direction and the first planar surface 29$d_1$ of the distal end of the locking lever 29 is going to readily get over the protrusion 22*d* of the locking cam 22.

In the state shown in FIGS. 16 and 16A, the locking lever 29 is located at the ON/OFF switching point III of the lock contact (see the bold line in FIG. 16A). In the ON/OFF switching point III of the lock contact, as shown in the table of FIG. 16, the lock state of the locking cam 22 is in the state of shifting from "Unlock to Lock", the solenoid 28 (FIG. 5) is "OFF", the lock contact is in the state of shifting from "OFF to ON", and the unlock contact is turned "OFF".

Figure 17:
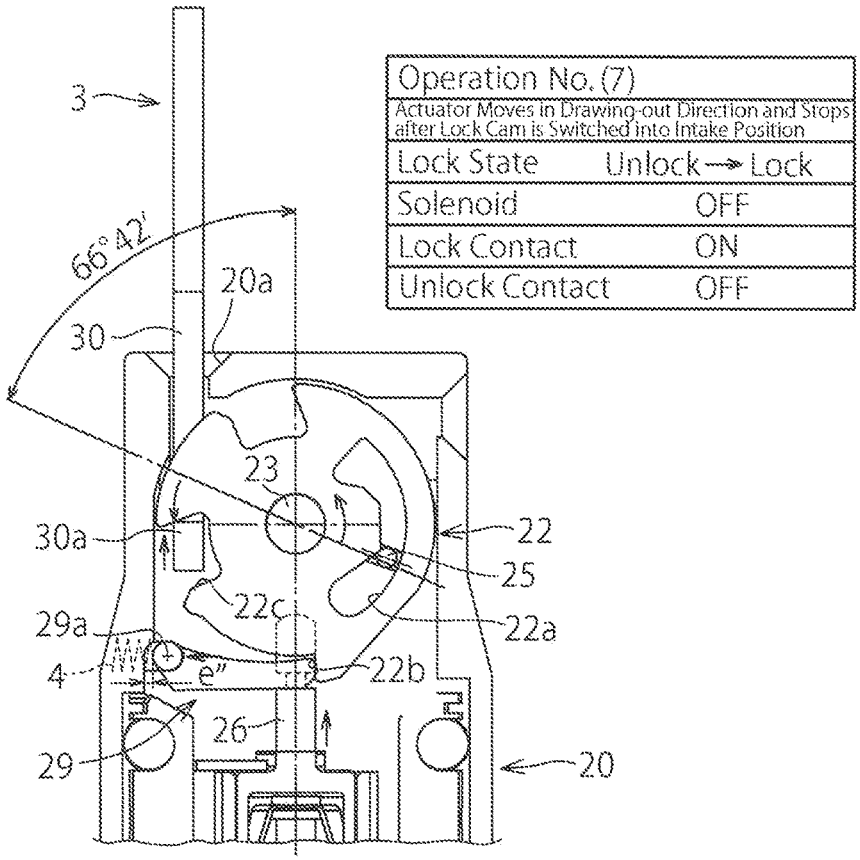
FIG. 17 is a schematic illustrating the state in which the operating rod of the safety switch of FIG. 1 moves further upwardly from the state shown in FIG. 16.
Figure 17A:
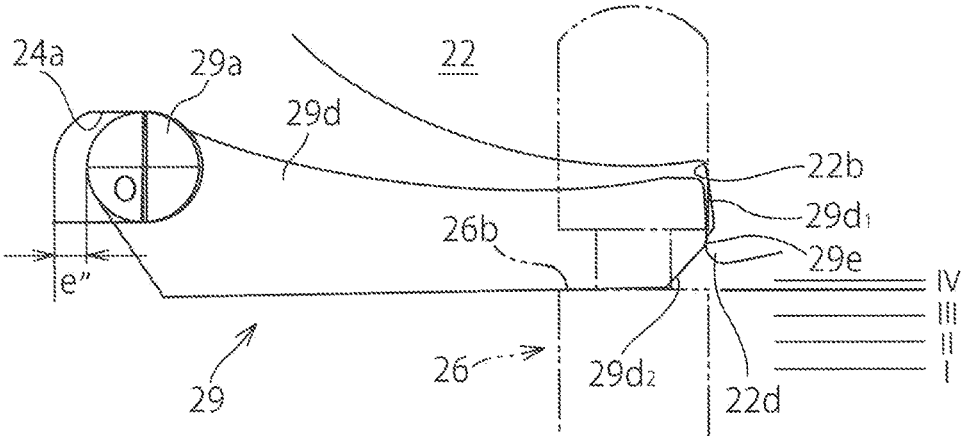
FIG. 17A is an enlarged view of the locking lever portion of FIG. 17.

Operation No. (7) shown in FIG. 17 illustrates the state in which the locking lever 29 rotates further upwardly from the state of the operation No. (6) in FIG. 16. At this moment, as shown in FIG. 17A, the ridge line 29*e* at the distal end of the locking lever 29 run aground to the protrusion 22*d* of the locking cam 22 and the locking lever 29 moves further to the left thus absorbing interference with the protrusion 22*d* of the locking cam 22. A gap e" after interference is smaller than the gap e', that is, e"<e'. Thereby, rotation of the locking lever 29 in the upward direction can be conducted in a smooth manner. As a result, the locking lever 29 does not stop halfway at the time of rotation in the upward direction and the ridge line 29*e* of the locking lever 29 is going to readily get over the protrusion 22*d* of the locking cam 22.

In the state shown in FIGS. 17 and 17A, the locking lever 29 is located immediately adjacent the lock position IV (see the bold line in FIG. 17A). In the lock position VI, as shown in the table of FIG. 17, the lock state of the locking cam 22 is in the state of shifting from "Unlock to Lock", the solenoid 28 (FIG. 5) is "OFF", the lock contact is turned "ON", and the unlock contact is "OFF".

Figure 18:
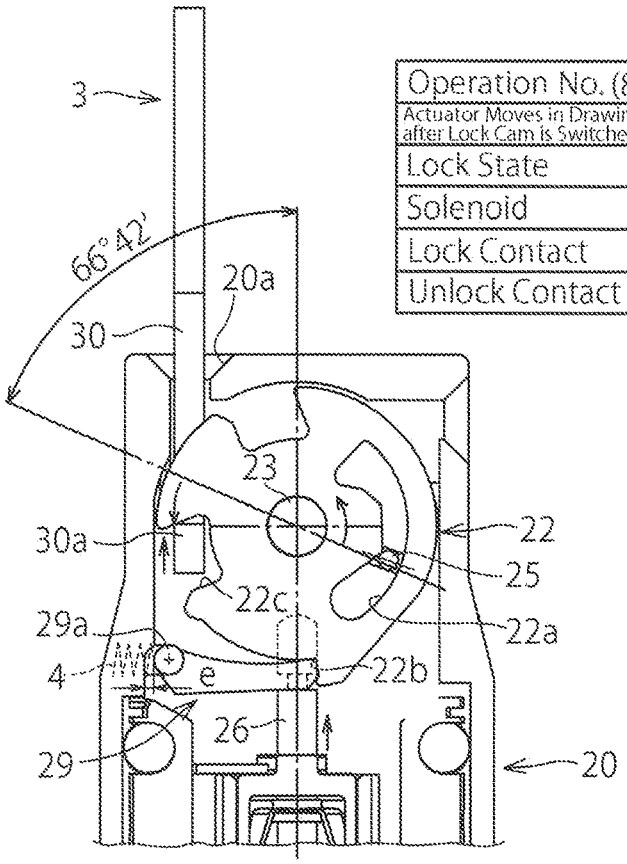
FIG. 18 is a schematic illustrating the state in which the operating rod of the safety switch of FIG. 1 moves further upwardly from the state shown in FIG. 17 and the looking lever is transferred to the lock position.
Figure 18A:
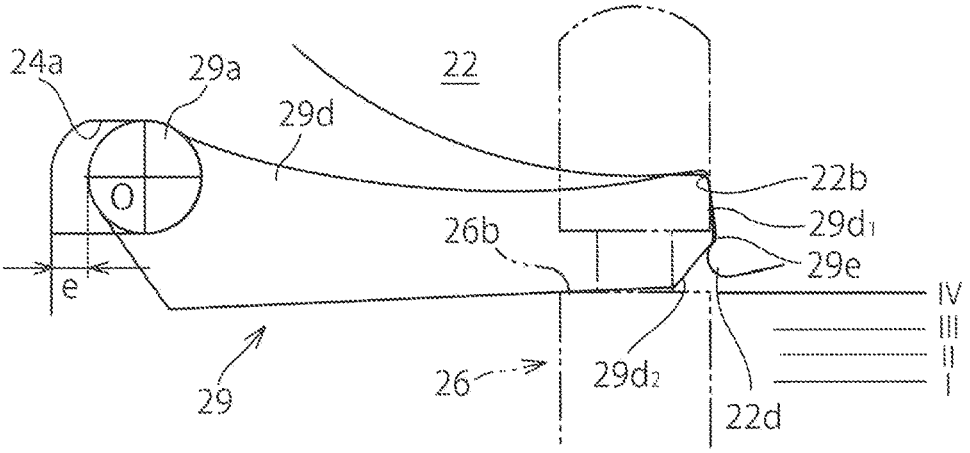
FIG. 18A is an enlarged view of the locking lever portion of FIG. 18.

Operation No. (8) shown in FIG. 18 illustrates the state in which the locking lever 29 rotates further upwardly from the state of the operation No. (7) in FIG. 17. At this moment, as shown in FIG. 18A, the first planar surface 29$d_1$ of the distal end of the locking lever 29 engages with the engagement surface 22*b* of the locking cam 22 and the second planar surface 29$d_2$ of the distal end of the locking lever 29 is disposed above the protrusion 22*d* of the locking cam 22. Thereby, the distal end surface of the locking lever 29 is fitted into a concave portion formed above the protrusion 22*d* of the locking cam 22.

In the state shown in FIGS. 18 and 18A, the locking lever 29 is located at the lock position IV (see the bold line in FIG. 18A). In the lock position VI, as shown in the table of FIG. 18, the lock state of the locking cam 22 is turned "Lock", the solenoid 28 (FIG. 5) is "OFF", the lock contact is "ON", and the unlock contact is "OFF".

In such a manner, in the process of locking motion that shifts from the state of FIG. 14 through the state of FIGS. 15, 16 and 17 to the state of FIG. 18, the locking lever 29 readily goes through the state of FIGS. 15, 16 and 17 to the state of FIG. 18 without stopping by a frictional force with the locking cam 22 in the state of FIGS. 15, 16 and 17. Thereby, even in the case that a plurality of lock/unlock contacts are provided, it can be prevented that the state of being mixed with ON-state contacts and OFF-state contacts occurs and that incoincidence of the contacts occurs. As a result, a machine stop resulted from incoincidence of contacts can be prevented from occurring, thus improving work efficiency.

Then, operation will be explained in reference to FIGS. 19 to 22A when the solenoid 28 (FIG. 5) is turned "ON" with the locking lever 29 located at the lock position IV and the actuator 3 is pulled in the drawing-out direction. In these drawings, coloring in gray or hatching to designate a sectional portion is omitted for illustration purposes.

Figure 19:
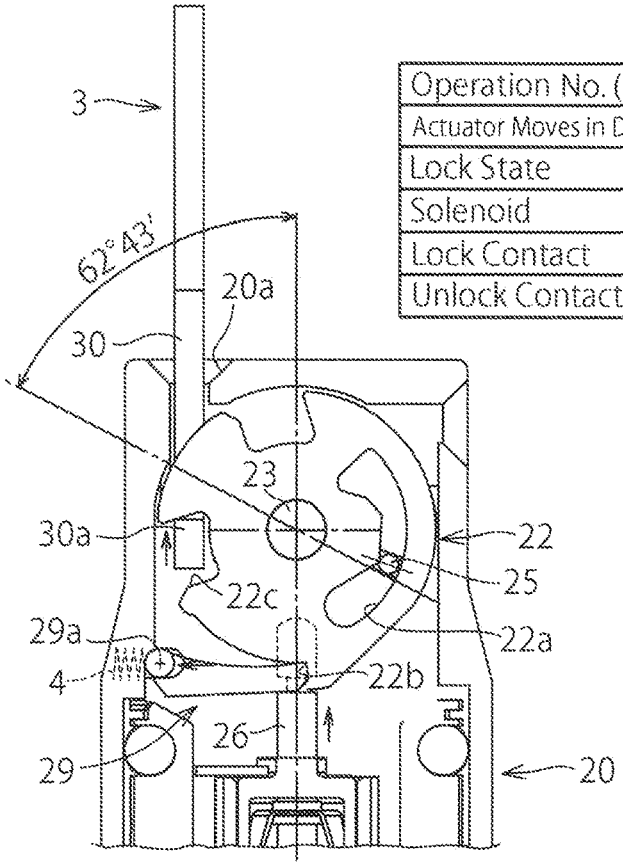
FIG. 19 is a schematic illustrating the state in which the locking lever of the safety switch of FIG. 1 is locked between the supporting shaft and the locking cam by puling the actuator in the drawing-out direction with the locking lever disposed at the lock position.
Figure 19A:
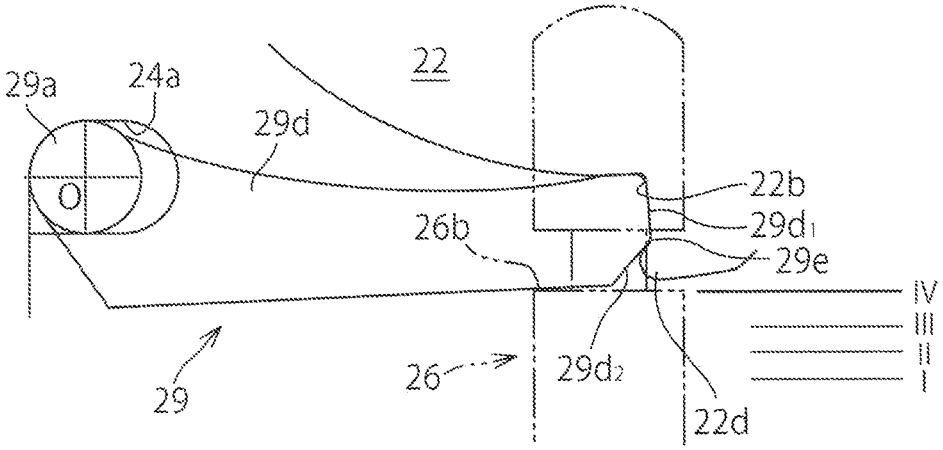
FIG. 19A is an enlarged view of the locking lever portion of FIG. 19.

Operation No. (9) shown in FIG. 19 illustrates the state in which the actuator 3 is pulled in the drawing-out direction with the locking lever 29 located at the lock position. At this time, as shown in FIG. 19A, a pressing force from the engagement surface 22*b* of the locking cam 22 acts onto the distal end surface of the locking lever 29 with the distal end surface of the locking lever 29 fitted into the concave portion formed above the protrusion 22*d* of the locking cam 22. As a result, the locking lever 29 moves to the left in FIG. 19A thus causing the gap e (FIG. 18A) between the supporting shaft 29*a* and the elongated hole 24*a* to be zero. At this moment, the locking lever 29 is completely locked between the engagement surface 22*b* of the locking cam 22 and the elongated hole 24*a*. Therefore, even if the solenoid 28 (FIG. 5) is turned "ON" in this lock state, the locking lever 29 cannot rotate downwardly.

In the state shown in FIGS. 19 and 19A, the locking lever 29 is located at the lock position IV (see the bold line in FIG. 19A). At this moment, as shown in the table of FIG. 19, the lock state of the locking cam 22 is in the state of "Lock", the solenoid 28 (FIG. 5) is "OFF", the lock contact is "ON", and the unlock contact is "OFF".

Figure 20:
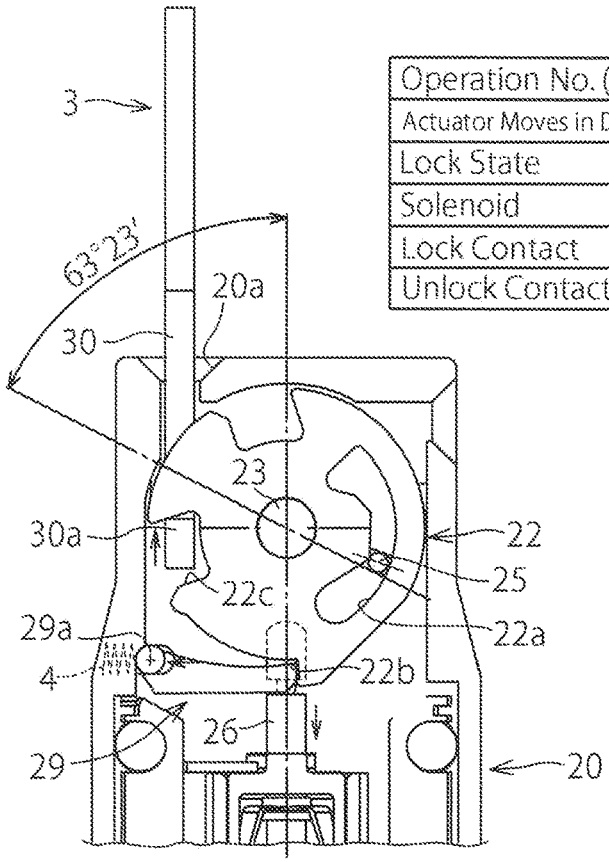
FIG. 20 is a schematic illustrating the state in which the operating rod of the safety switch of FIG. 1 is in the middle of moving downwardly by gradually releasing the tense state of the actuator of FIG. 19.

Operation No. (10) shown in FIG. 20 illustrates the state in which the solenoid 28 is turned "ON" from the state of the operation No. (9) in FIG. 19 and the locking lever 29 rotates downwardly by slightly loosening the tense state of the actuator 3 in the drawing-out direction. During the downward rotation of the locking lever 29, shown in FIG. 20A, the second planar surface 29$d_2$ of the distal end of the locking lever 29 gets over the protrusion 22*d* of the locking cam 22 and then the first planar surface 29$d_1$ of the distal end of the locking lever 29 slides along the protrusion 22*d* with the first planar surface 29$d_1$ running aground the protrusion 22*d* subsequently to the ridge line 29*e*.

Figure 20A:
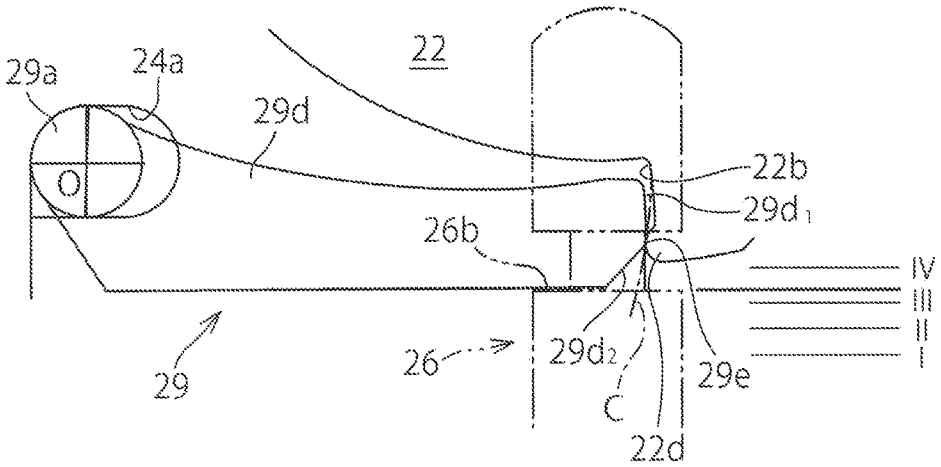
FIG. 20A is an enlarged view of the locking lever portion of FIG. 20.
Figure 20B:
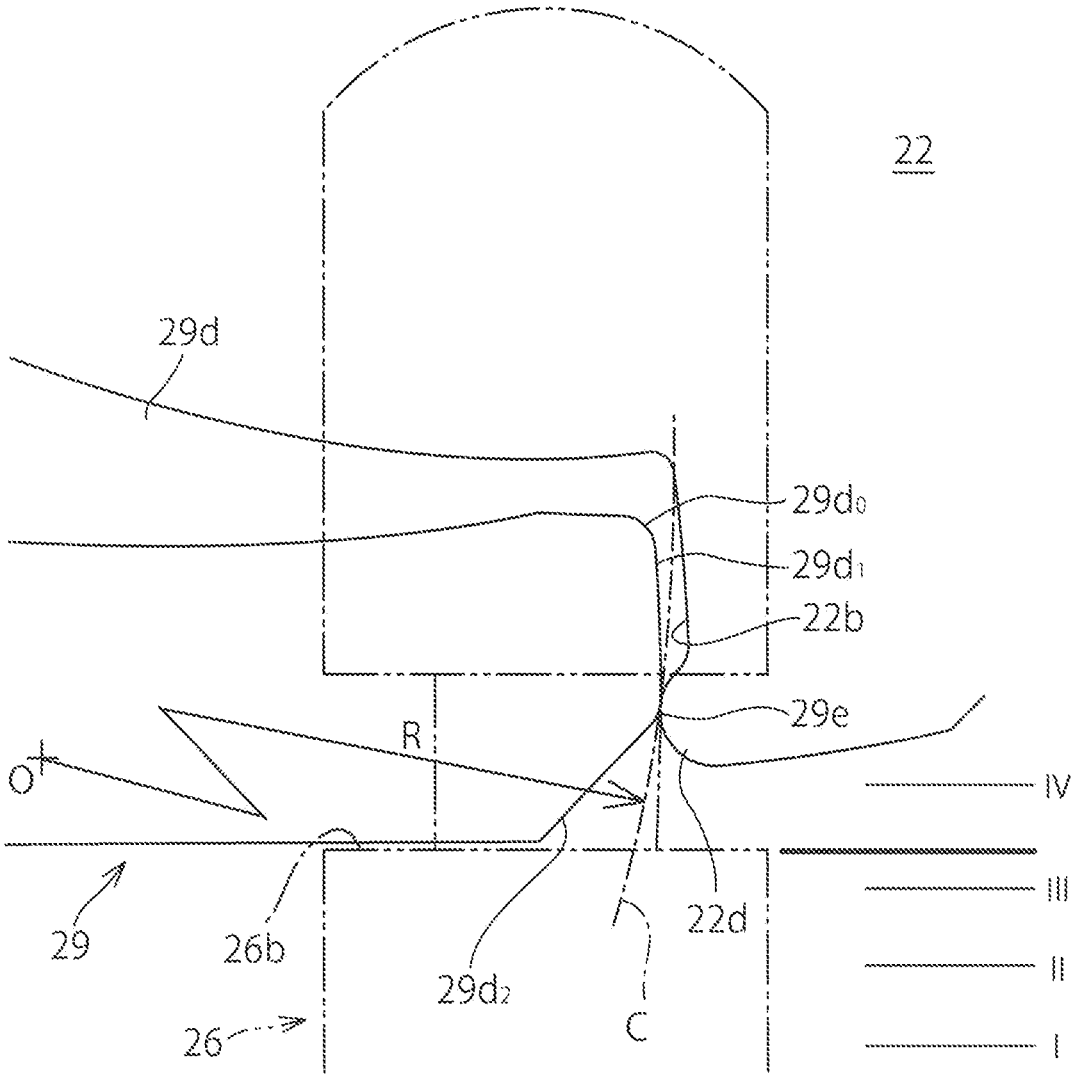
FIG. 20B is a partially detailed view of FIG. 20A.

At this time, as shown in FIG. 20B or a partially detailed view of FIG. 20A, when drawing a circular arc C having a center at the rotational center O of the locking lever 29 and a radius of a distance R from the center O to the ridge line 29*e*, both of the first and second planar surfaces 29$d_1$, 29$d_2$ are located inside the circular arc C and gradually separated away from the circular arc C as leaving the ridge line 29*e*. That is, when the locking lever 29 rotates around the rotational center O, the ridge line 29*e* is located at the position farthest from the rotational center O on the distal end surface of the locking lever 29 and it is the most prominent point on the distal end surface of the locking lever 29. Therefore, as the downward rotational movement of the locking lever 29 advances further, interference of the first planar surface 29$d_1$ of the locking lever 29 with the protrusion 22*d* is gradually reduced.

In the state shown in FIGS. 20 and 20A, the locking lever 29 is located at an intermediate position between the ON/OFF switching point III of the lock contact and the lock position IV (see the bold line in FIG. 20A). At this moment, as shown in the table of FIG. 20, the lock state of the locking cam 22 is "Lock", the solenoid 28 (FIG. 5) is turned "ON", the lock contact is "ON", and the unlock contact is "OFF".

Figure 21:
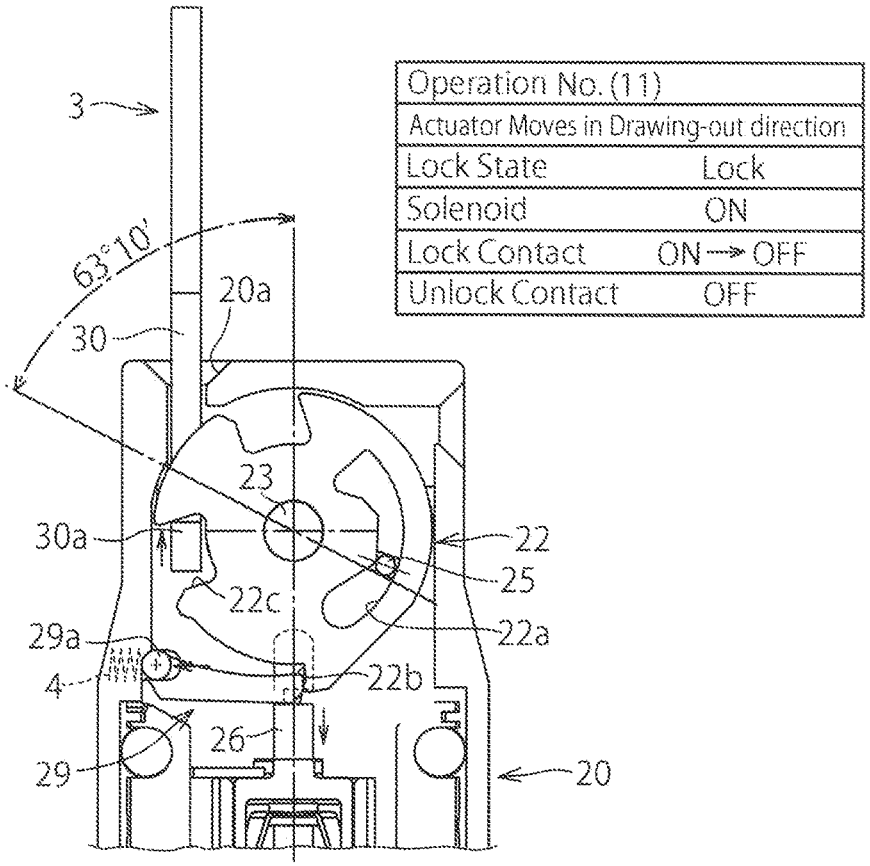
FIG. 21 is a schematic illustrating the state in which the operating rod of the safety switch of FIG. 1 moves further downwardly from the state shown in FIG. 20.

Operation No. (11) shown in FIG. 21 illustrates the state in which the locking lever 29 rotates further downwardly from the state of the operation No. (10) in FIG. 20. During the rotation of the locking lever 29, shown in FIG. 21A, the first planar surface $29d_1$ at the distal end of the locking lever 29 slides along the protrusion 22*d* of the locking cam 22 in contact with the protrusion 22*d*.

At this time, as above-mentioned, as the downward rotational movement of the locking lever 29 advances further, interference of the first planar surface $29d_1$ of the locking lever 29 with the protrusion 22*d* is gradually reduced and downward rotation of the locking lever 29 is thus conducted in a smooth manner. Thereby, the first planar surface $29d_1$ of the locking lever 29 is going to readily get over the protrusion 22*d* of the locking cam 22.

Figure 21A:
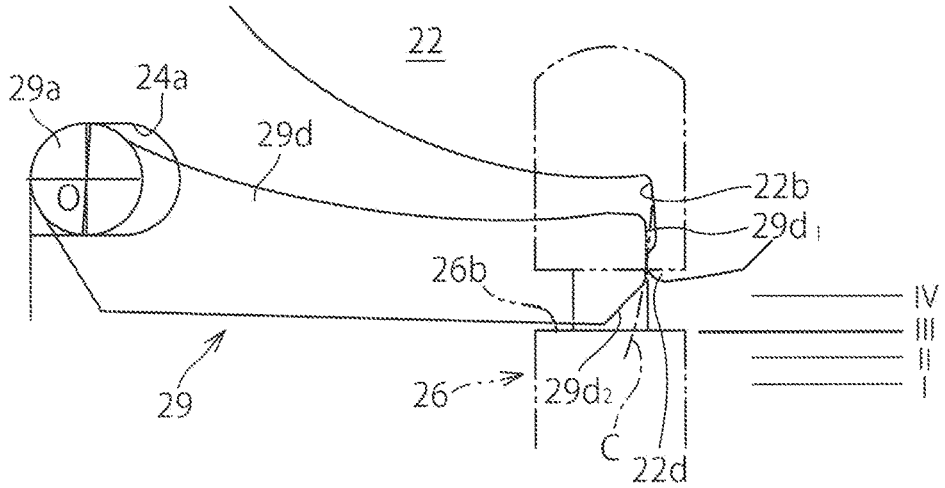
FIG. 21A is an enlarged view of the locking lever portion of FIG. 21.

In the state shown in FIGS. 21 and 21A, the locking lever 29 is located at the ON/OFF switching point III (see the bold line in FIG. 21A). At this moment, as shown in the table of FIG. 21, the lock state of the locking cam 22 is "Lock", the solenoid 28 (FIG. 5) is "ON", the lock contact is in the state of shifting from "ON to OFF", and the unlock contact is "OFF".

Figure 22:
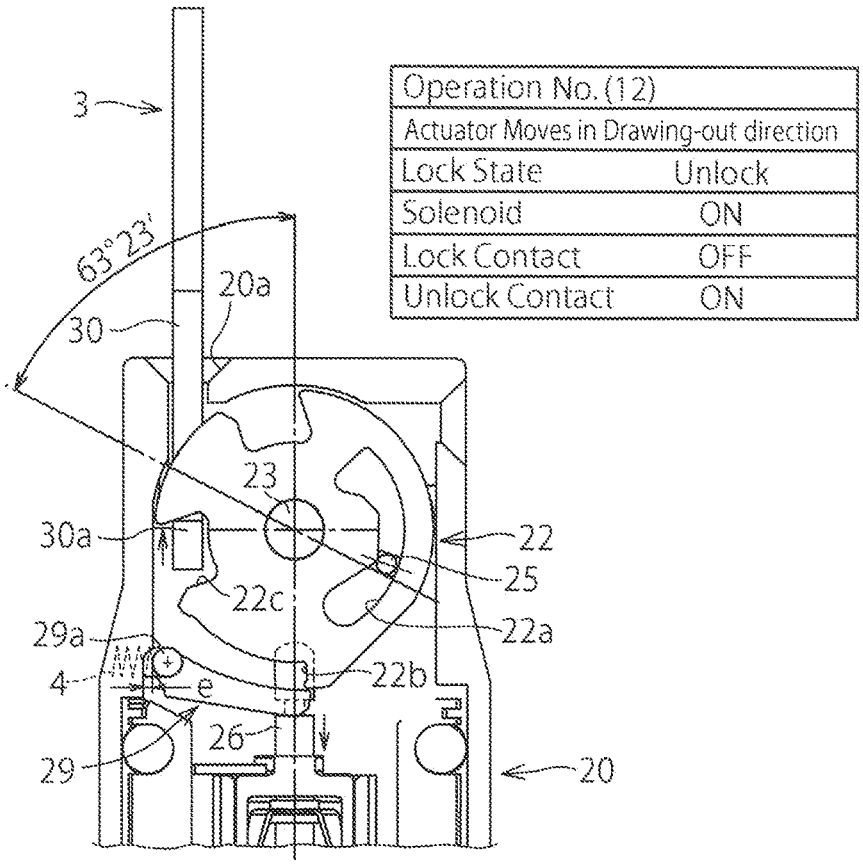
FIG. 22 is a schematic illustrating the state in which the operating rod of the safety switch of FIG. 1 moves further downwardly from the state shown in FIG. 21 and the looking lever is transferred to the unlock position.
Figure 22A:
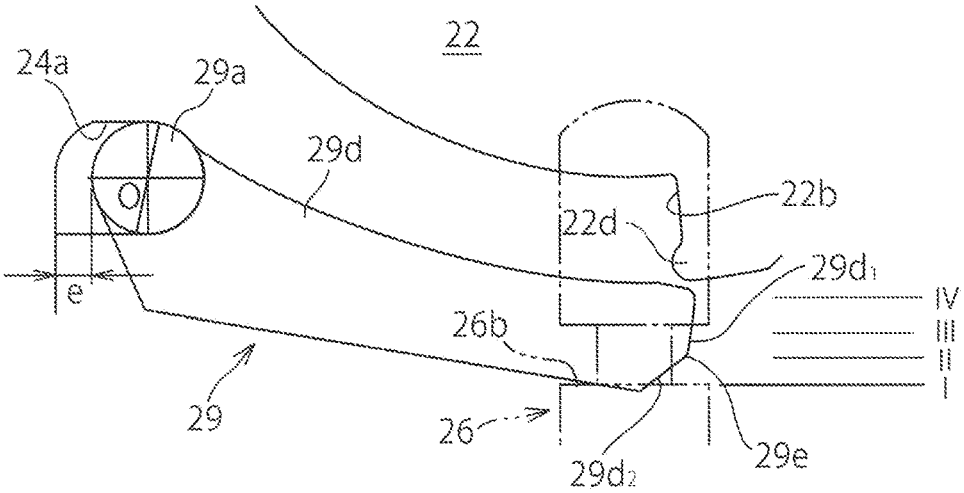
FIG. 22A is an enlarged view of the locking lever portion of FIG. 22.

Operation No. (12) shown in FIG. 22 illustrates the state in which the locking lever 29 rotates further downwardly from the state of the operation No. (11) in FIG. 21. At this time, as shown in FIG. 22A, the first planar surface $29d_1$ at the distal end of the locking lever 29 is disengaged from the protrusion 22*d* of the locking cam 22 and the distal end surface of the locking lever 29 moves below the protrusion 22*d* of the locking cam 22. Also, at this moment, the locking lever 29 moves to the right in FIG. 22A due to the spring force imparted by the spring 4 onto the supporting shaft 29*a* of the locking lever 29. There is formed a gap e between the left-side opening end of the elongated hole 24*a* and the supporting shaft 29*a*.

In the state shown in FIGS. 22 and 22A, the locking lever 29 is located at the unlock state I (see the bold line in FIG. 22A). At this moment, as shown in the table of FIG. 22, the lock state of the locking cam 22 is turned "Unlock", the solenoid 28 (FIG. 5) is "ON", the lock contact is turned "OFF", and the unlock contact is turned "ON". Also, in this state, even if the excitation of the solenoid 28 is released, since the protrusion 22*d* of the locking cam 22 is located above the distal end portion of the locking lever 29, the locking lever 29 cannot rotate upwardly and thus the lock state of the locking cam 22 is not turned "Lock".

In such a fashion, in the process of unlock operation that shifts from the state of FIG. 19 through the state of FIGS. 20 and 21 to the state of FIG. 22, the locking lever 29 readily goes through the state of FIGS. 20 and 21 to shift to the state of FIG. 22 without stopping due to the frictional force with the locking cam 22 in the state of FIGS. 20 and 21. Thereby, even in the case that a plurality of lock/unlock contacts are provided, it can be prevented that the state of being mixed with ON-state contacts and OFF-state contacts occurs and that incoincidence of the contacts occurs. As a result, a machine stop resulted from incoincidence of the contacts can be prevented, thus improving work efficiency.

The embodiment suitable for the present invention has been explained above, but application of the present invention is not limited to such an embodiment. The present invention contains various alternative embodiments. Some of the alternative embodiments are described below.

First Alternative Embodiment

In the above-mentioned embodiment, an example was shown in which the bulge 29*f* provided on the distal end surface of the locking lever 29 is formed by the first and second planar surfaces $29d_1$, $29d_2$ that intersect each other, but application of the present invention is not limited to such an embodiment. The distal end surface of the locking lever 29 may be formed by a circular arc shape of a single or a plurality of circular arcs. In this case, for example, a convex arc shape may be used that is composed of a small circular arc of a radius r (r<R) and that inscribes inside the circular arc C in FIGS. 9 and 20B at the ridge line 29*e*.

Figure 23:
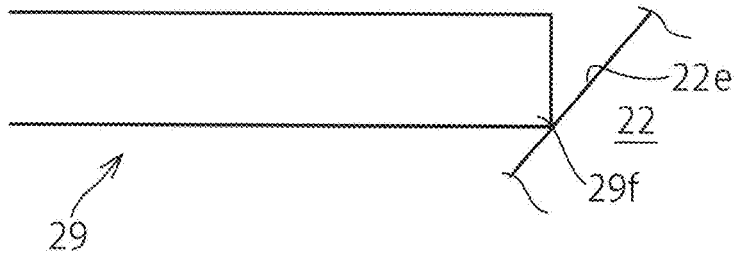
FIG. 23 is a schematic diagram showing an alternative variant of the bulge of the locking lever according to the present invention.
Figure 24:
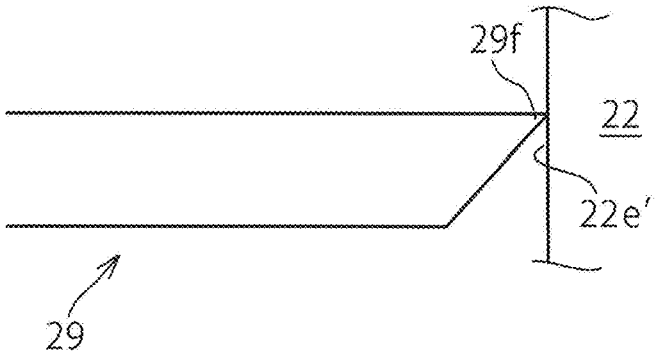
FIG. 24 is a schematic diagram showing another alternative variant of the bulge of the locking lever according to the present invention.
Figure 25:
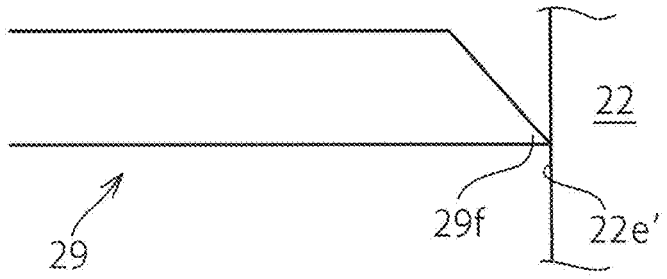
FIG. 25 is a schematic diagram showing a further alternative variant of the bulge of the locking lever according to the present invention.

Also, the bulge 29*f* of the locking lever 29 may have such a shape as shown in FIGS. 23 to 25. In these drawings, like reference numbers indicate identical or functionally similar elements.

In FIG. 23, the distal end of the locking lever 29 has a squared shape, one of whose corners protrudes toward an inclined surface 22*e* of the locking cam 22 to be contacted and such a corner constitutes the bulge 29*f*. In FIGS. 24 and 25, the distal end of the locking lever 29 has a triangular or a knife-edge shape, whose pointed end (i.e. an upper-side end in FIG. 24; a lower-side end in FIG. 25) protrudes toward an inclined surface 22*e*' of the locking cam 22 to be contacted and such a pointed end constitutes the bulge 29*f*.

Second Alternative Embodiment

In the above-mentioned embodiment, an example was shown in which the protrusion 22*d* having a semicircular shape in cross section is formed at the engagement surface 22*b* of the locking cam 22, but application of the present invention is not limited to such an example. The protrusion 22*d* can be omitted. Also, in lieu of the semicircular shaped protrusion 22*d*, an angle-shaped or a V-shaped protrusion that is formed by two intersecting planar surfaces may be provided. Alternatively, a trapezoidal protrusion may be used.

Third Alternative Embodiment

In the above-mentioned embodiment, an example was shown in which the supporting shaft 29*a* of the locking lever 29 is housed in the elongated hole 24*a* of the cam supporting portion 24 via the radial gap e, but application of the present invention is not limited to such an example. The present invention also has application to an example in which the supporting shaft 29*a* of the locking lever 29 may be housed in a circular hole formed in the cam supporting portion 24 without a radial gap.

Fourth Alternative Embodiment

In the above-mentioned embodiment, an example was shown in which the locking lever 29 as a locking part is provided rotatable around the center axis line of the supporting shaft 29*a*, but application of the present invention is not limited to such an example. In the present invention, it is possible to use a locking part that reciprocates relative to the engagement surface 22*b* of the locking cam 22 to engage with the engagement surface 22*b*.

Fifth Alternative Embodiment

In the above-mentioned embodiment, an example was shown in which the cam according to the present invention is composed of the operating cam 21 and a pair of locking cams 22, that is, the entire cam composed of the operating cam 21 and a pair of locking cams 22 is regarded as one cam assembly, but application of the present invention is not limited to such an example. For example, only the operating cam as a cam according to the present invention may be provided and the operation cam may be structured to have the function of the locking cam as well.

INDUSTRIAL APPLICABILITY

The present invention is of use to a safety switch, and it is especially suitable to a structure for securely preventing occurrence of incoincidence of contacts.

DESCRIPTION OF REFERENCE NUMERALS

1: safety switch
2: switch body
21, 22: cam
22*d*: protrusion (convex portion)
26: operating rod (operating part)
29: locking lever (locking part)
29*a*: supporting shaft
29$d_1$: first planar surface
29$d_2$: second planar surface
29*e*: ridge line (boundary)
29*f*: bulge
3: actuator
e: gap
I: unlock position
IV: lock position

The invention claimed is:

1. A safety switch that comprises a switch body and an actuator, in which a contact state of said safety switch is switched by cooperation of said actuator and said switch body, wherein said switch body comprises:

a cam that is configured and adapted to make a forward rotation by insertion of said actuator into said switch body and to make a reverse rotation by extraction of said actuator from said switch body, and that includes a recess formed on an outer circumference of said cam;

an operating part that is configured and adapted to move toward and away relative to said cam to switch the contact state of said safety switch; and a locking part that is in direct contact with said operating part, whereby said locking part is directly coupled with said operating part such that said locking part is movably linked with a motion of said operating part so that said locking part takes a lock position in which said locking part moves toward said cam and locks rotation of said cam to establish a lock state of said cam with said actuator inserted into said switch body, an unlock position in which said locking part moves away from said cam and unlocks the lock state of said cam, and an intermediate position between the lock position and the unlock position;

wherein said cam includes an engagement surface in said recess for the lock state of said cam and said locking part includes a distal end surface such that said engagement surface and said distal end surface are disposed opposite and engage with one another in the lock position with said actuator inserted into said switch body, and said distal end surface is formed of a first planar surface and a second planar surface that intersect one another to form a bulge that protrudes toward said cam at a portion of said distal end surface;

wherein, when said actuator moves in an extraction direction in an intermediate position between the lock position and the unlock position, said bulge at said portion of said distal end surface is configured and adapted to contact said cam, such that said bulge is slidable along said engagement surface of said cam during the reverse rotation of said cam in the intermediate position of said locking part, wherein said locking part is elastically supported through a gap.

2. A safety switch that comprises a switch body and an actuator, in which a contact state of said safety switch is switched by cooperation of said actuator and said switch body, wherein said switch body comprises:

a cam that is configured and adapted to make a forward rotation by insertion of said actuator into said switch body and to make a reverse rotation by extraction of said actuator from said switch body, and that includes a recess formed on an outer circumference of said cam;

an operating part that is configured and adapted to move toward and away relative to said cam to switch the contact state of said safety switch; and a locking part that is in direct contact with said operating part, whereby said locking part is directly coupled with said operating part such that said locking part is movably linked with a motion of said operating part so that said locking part takes a lock position in which said locking part moves toward said cam and locks rotation of said cam to establish a lock state of said cam with said actuator inserted into said switch body, an unlock position in which said locking part moves away from said cam and unlocks the lock state of said cam, and an intermediate position between the lock position and the unlock position;

wherein said cam includes an engagement surface in said recess for the lock state of said cam and said locking part includes a distal end surface such that said engagement surface and said distal end surface are disposed opposite and engage with one another in the lock position with said actuator inserted into said switch body, and said distal end surface is formed of a first planar surface and a second planar surface that intersect one another to form a bulge at a portion of said distal end surface such that said bulge is slidable along said engagement surface of said cam during the reverse rotation of said cam in the intermediate position of said locking part.

3. The safety switch according to claim 2, wherein said locking part is supported rotatably, and a distance from a rotational center of said locking part to said distal end surface is at a maximum value thereof at a boundary between said first planar surface and said second planar surface of said distal end surface.

4. The safety switch according to claim 2, wherein said cam has a convex portion at a portion of said engagement surface, and said safety switch is configured so that said bulge of said locking part travels while abutting on said convex portion of said cam as said locking part moves through the intermediate position between the lock position and the unlock position.

5. The safety switch according to claim 4, wherein said locking part is elastically supported through a gap that is configured and adapted to absorb an interference with said convex portion of said cam.

6. The safety switch according to claim 2, wherein said locking part is rotatably supported by a supporting axis and said supporting axis is elastically supported through a radial gap.

7. The safety switch according to claim 2, wherein said distal end surface of said locking part has an angular shape formed by said first and second planar surfaces intersecting one another, and said angular shape forms said bulge.

8. The safety switch according to claim 2, wherein, in the lock position with said actuator inserted into said switch body, said first planar surface is located at a leading engagement side relative to said engagement surface for the lock state of said cam, and said second planar surface is located at a trailing engagement side relative to said engagement surface for the lock state of said cam.

* * * * *